US005819149A

United States Patent [19]

Watanabe et al.

[11] Patent Number: 5,819,149

[45] Date of Patent: Oct. 6, 1998

[54] IMAGE FORMING APPARATUS PREVENTING CHANGE OF SIZE OF IMAGE

[75] Inventors: Yasunari Watanabe, Susono; Yasumasa Otsuka; Hiroshi Hashimoto, both of Toride; Manabu Takano, Tokyo, all of Japan

[73] Assignee: Canon Kabushiki Kaisha, Tokyo, Japan

[21] Appl. No.: 738,599

[22] Filed: Oct. 29, 1996

[30] Foreign Application Priority Data

| | | | |
|---|---|---|---|
| Nov. 1, 1995 | [JP] | Japan | 7-285191 |
| Jan. 23, 1996 | [JP] | Japan | 8-028438 |
| May 24, 1996 | [JP] | Japan | 8-153267 |

[51] Int. Cl.[6] ..... G03G 15/20; G03G 21/00

[52] U.S. Cl. ..... 399/330; 399/68; 399/44

[58] Field of Search ..... 399/330, 328, 399/335, 67–69, 38, 33, 44

[56] References Cited

U.S. PATENT DOCUMENTS

| | | | |
|---|---|---|---|
| 4,949,104 | 8/1990 | Negoro et al. . | |
| 5,170,215 | 12/1992 | Pfeuffer | 355/285 |
| 5,285,245 | 2/1994 | Goto et al. . | |
| 5,289,247 | 2/1994 | Takano et al. . | |
| 5,374,983 | 12/1994 | Isogai . | |
| 5,455,659 | 10/1995 | Ishizu et al. . | |

FOREIGN PATENT DOCUMENTS

| | | |
|---|---|---|
| 363686 | 4/1990 | European Pat. Off. . |
| 457330 | 11/1991 | European Pat. Off. . |
| 671666 | 9/1995 | European Pat. Off. . |
| 4112032 | 4/1990 | Germany . |
| 56-050343 | 5/1981 | Japan . |
| 63-296081 | 12/1988 | Japan . |
| 2-248977 | 10/1990 | Japan . |
| 4-44075 | 2/1992 | Japan . |
| 4-44076 | 2/1992 | Japan . |
| 4-44077 | 2/1992 | Japan . |
| 4-44078 | 2/1992 | Japan . |
| 4-44079 | 2/1992 | Japan . |
| 4-44080 | 2/1992 | Japan . |
| 4-44081 | 2/1992 | Japan . |
| 4-44082 | 2/1992 | Japan . |
| 4-44083 | 2/1992 | Japan . |
| 4-204980 | 7/1992 | Japan . |
| 4-204981 | 7/1992 | Japan . |
| 4-204982 | 7/1992 | Japan . |
| 4-204983 | 7/1992 | Japan . |
| 4-204984 | 7/1992 | Japan . |
| 2257424 | 1/1993 | United Kingdom . |

OTHER PUBLICATIONS

Patent Abstracts of Japan, vol. 15, No. 218, P1210 Jun. 4, 1991 and JP–A–0361961, Mar. 18, 1991.

Patent Abstracts of Japan, vol. 16, No. 24, P1301, Jan. 21, 1992 and JP–A–03238471, Oct. 24, 1991.

Patent Abstracts of Japan, vol. 17, No. 60, P1482, Feb. 5, 1993 and JP–A–04270353, Sep. 25, 1992.

*Primary Examiner*—R. L. Moses

*Attorney, Agent, or Firm*—Fitzpatrick, Cella, Harper & Scinto

[57] ABSTRACT

An image forming apparatus has a movable image bearing member on which an unfixed image is formed, transfer device for transferring the unfixed image on the image bearing member onto a recording medium, fixing device for heating and fixing the unfixed image transferred by the transfer means on the recording medium. The fixing device has a driving rotatable member for conveying the recording medium. The recording medium during the transfer by the transfer device is conveyed by the driving rotatable member. The apparatus is provided with detecting device for detecting information regarding the peripheral velocity of the driving rotatable member, and control device for controlling the movement speed of the image bearing member on the basis of the result of the detection by the detecting device.

26 Claims, 28 Drawing Sheets

IMAGE FORMING APPARATUS PREVENTING CHANGE OF SIZE OF IMAGE

BACKGROUND OF THE INVENTION

1. Field of the Invention

This invention relates to an image forming apparatus such as a copying apparatus or a printer, and particularly to an apparatus in which a recording medium during transfer is conveyed by a fixing device.

2. Related Background Art

In an image forming apparatus such as a laser beam printer, an electrophotographic copying apparatus or a facsimile apparatus, a developed image such as a toner image borne by an image bearing member such as a photosensitive drum is transferred to a recording medium in the transfer process. The unfixed toner image carried on the recording medium is fixed on the recording medium by a fixing device.

As a fixing device, use is generally made of a heating device for heating and melting a toner image and fixing it on a recording medium, and as such heating device, there has heretofore been proposed a heat roller type in which a recording medium is heated while being held between and conveyed by a heating roller maintained at a predetermined temperature and a pressure roller having an elastic layer and urged against the heating roller.

In addition, various types such as a flash heating type, an open heating type and a hot plate heating type are known and have been put into practical use.

On the other hand, recently, there has been proposed a fixing device of a type having a fixedly supported heating member, heat-resisting film (hereinafter referred to as the fixing film) conveyed while being opposed to and urged against the heating member, and a pressure member such as a pressure roller for bringing a recording medium into close contact with the heating member with the fixing film interposed therebetween, and in which the heat of the heating member is imparted to the recording medium through the fixing film to thereby cause an unfixed image carried on the recording medium to be heated and fixed on the recording medium (hereinafter referred to as the film heating type).

In the film type fixing device, a heating member of low heat capacity can be used as a heating member. Therefore, as compared to the conventional contact heating type in which an unfixed toner image is direct brought into contact with a heating roller to thereby fix it on a recording medium, electric power saving and shortening of the wait time until the image can be fixed become possible and in the other points, there are various advantages as compared with the conventional fixing device, and the fixing device of the film heating type is very effective.

Now, in the fixing device of the film heating type, if the temperature of the pressure roller rises when the fixing film and the recording medium are conveyed while the pressure roller is rotatively driven, the outer diameter of the pressure roller becomes larger due to the thermal expansion of the rubber portion thereof. Also, the pressure roller is rotatively driven at a predetermined number of rotations. Therefore, the conveyance velocity of the recording medium becomes higher when the pressure roller is at a high temperature than when the pressure roller is at a low temperature.

When the recording medium is present in a transfer portion and a fixing portion simultaneously so that the leading end of the recording medium in the conveying direction may enter the fixing portion of the fixing device and the trailing end of the recording medium in the conveying direction may still be in the transfer process, the conveyance velocity of the recording medium becomes higher than the peripheral velocity of a photosensitive drum due to an increase in the outer diameter of the pressure roller and thus, the transferred image extends in the conveying direction.

A situation in which such a state occurs will hereinafter be described with a printer of the electrophotographic type shown, for example, in FIG. 7 of the accompanying drawings which is the background art of the present invention taken as an example. In the printer shown in FIG. 7, a control device (CPU) 14 governing the drive control of a printer body is adapted to effect the rotative drive control of the body main motor 9, and the rotative drive force of the body main motor 9 is transmitted to the pressure roller 7 of a fixing device 4 and a transfer roller 3 through a power transmitting mechanism, not shown.

The fixing device 4 has endless fixing film 6 disposed so as to surround a heating member 5 extending in a direction perpendicular to the plane of the drawing sheet of FIG. 7, and the pressure roller 7 is pressed against the heating member 5 with the fixing film 6 interposed therebetween.

Also, around a photosensitive drum 1 which is an image bearing member, a charging device 11 comprised of a charging roller or the like for charging the photosensitive drum 1, an exposure device 2 such as a laser device, a developing device 12 containing therein a toner which is a developer, a transfer roller 3 for transferring a toner image developed by the developing device 12 to a recording medium P, a cleaning device 13 for removing any remaining toner after transfer from the surface of the photosensitive drum 1, etc. are disposed as image forming process means, and the photosensitive drum 1 rotatable in the direction of arrow a is uniformly charged by the charging device 11, whereafter it is exposed to exposure light such as the laser beam of the exposure device 2 controlled by the CPU 14, whereby a latent image is formed on the surface of the photosensitive drum 1. This latent image is then developed by the developing device 12, and the visualized toner image is transferred onto the recording medium P fed toward a transfer position by a paper conveying mechanism, not shown, by the transfer roller 3, and is conveyed toward the fixing device 4 at the peripheral velocity of the photosensitive drum 1. The leading end of the recording medium P comes into the nip between the pressure roller 7 and the fixing roller 6 rotated in the directions of respective arrows, and the unfixed toner image is sequentially fixed on the recording medium P. The pressure roller 7 has a material such as rubber expandable by temperature provided on the surface of a mandrel, or the frictional force of the surface of the pressure roller is changed by temperature.

It is to be understood here that the process speed is 25 mm/sec., the outer peripheral length of the photosensitive drum 1 is 100 mm and the outer peripheral length of the pressure roller 7 at room temperature is 50 mm. The peripheral velocity of the photosensitive drum 1, the pressure roller 7, etc. during the ordinary time (the time when the pressure roller is not thermally expanded) is the process speed of 25 mm/sec. The distance between the transfer position and the fixing position is sufficiently short relative to the length of the recording medium P and the nip force of the transfer portion is sufficiently small as compared with the nip force of the fixing portion and thus, the conveying speed of the recording medium after transfer depends on the conveying force of the pressure roller 7.

In a normal state, the conveying speed of the recording medium P is equal to the peripheral velocity of the photosensitive drum 1 and therefore, the image on the photosensitive drum 1 and the image on the recording medium P after transfer are at one-to-one magnification in the lengthwise and widthwise directions (the conveying direction is the lengthwise direction).

The pressure roller 7 rises in temperature and is thermally expanded by the heat conduction from the heating member 5 while a predetermined number of recording mediums are fed. For example, when a pressure roller 7 having an outer peripheral length of 50 mm is increased by 1% in its outer peripheral length, the peripheral velocity of the pressure roller 7 becomes 25 mm/sec. and the conveyance speed of the recording medium P becomes equal thereto.

Now, since the peripheral velocity of the photosensitive drum 1 is 25 mm/sec., the phenomenon that the image on the photosensitive drum 1 elongates in the conveying direction when it is transferred to the recording medium P occurs. For example, in the case of a recording medium of A4, the rear end of the recording medium elongates by 2.9 mm. FIG. 8 of the accompanying drawings is a graph showing the relation between the number of recording mediums fed and the elongation of the image. By about 30 sheets of recording mediums being fed, the thermal expansion of the pressure roller is saturated and the elongation of the image is also saturated. This relation changes depending on the controlled temperature and control method of the fixing device, the material and construction of the pressure roller, the body construction, etc. of the conveying system, etc.

Such a relation changes also in the same printer, depending on the intermittent printing or like mode, the installation environment and the initial temperature (thermally expanded state) of the pressure roller.

On the other hand, in the case of a fixing device of the heat roller type according to the prior art, the temperature is controlled to a predetermined temperature in advance and the difference from the temperature of the fixing device during image formation has been small and therefore, the thermal expansion difference of the pressure roller has also been small. Also in a fixing device of the film heating type, if the temperature is controlled at a predetermined temperature in advance, the thermal expansion difference will also become small. However, normally electrically energizing is not preferable in order to sufficiently make the most of the characteristic that quick temperature rise makes it unnecessary to preheat the film fixing device during waiting which is an advantage peculiar to the film fixing device.

Also, if the distance between the transfer portion and the fixing portion is made long and the time for which the recording medium is present in the transfer portion and the fixing portion at a time is eliminated, the influence of the conveyance speed difference of the recording medium resulting from the thermal expansion difference of the pressure roller will become null, but this is not realistic because in a printer as the latest information output apparatus or an electrophotographic apparatus such as a copying apparatus, it is required that the first print time be shortened and the sizes of recording mediums are various.

SUMMARY OF THE INVENTION

It is an object of the present invention to provide an image forming apparatus in which even if the conveyance speed of a recording medium changes in a fixing portion, the size of an image on the recording medium will not change in a transfer portion.

It is another object of the present invention to provide an image forming apparatus in which the time of electrical energization of a heater is shortened and also the size of an image on a recording medium is prevented from changing in a transfer portion.

It is still another object of the present invention to provide an image forming apparatus which is compact and in which the size of an image on a recording medium is prevented from changing in a transfer portion.

It is yet still another object of the present invention to provide an image forming apparatus which has detecting means for detecting information regarding the peripheral velocity of the rotatively driving member of fixing means and in which the movement velocity of an image bearing member is controlled on the basis of the result of the detection by the detecting means.

Further objects of the present invention will become apparent from the following description.

DESCRIPTION OF THE PREFERRED EMBODIMENTS

Some embodiments of the present invention will hereinafter be described with reference to the drawings.

(First Embodiment)

Figure 1:
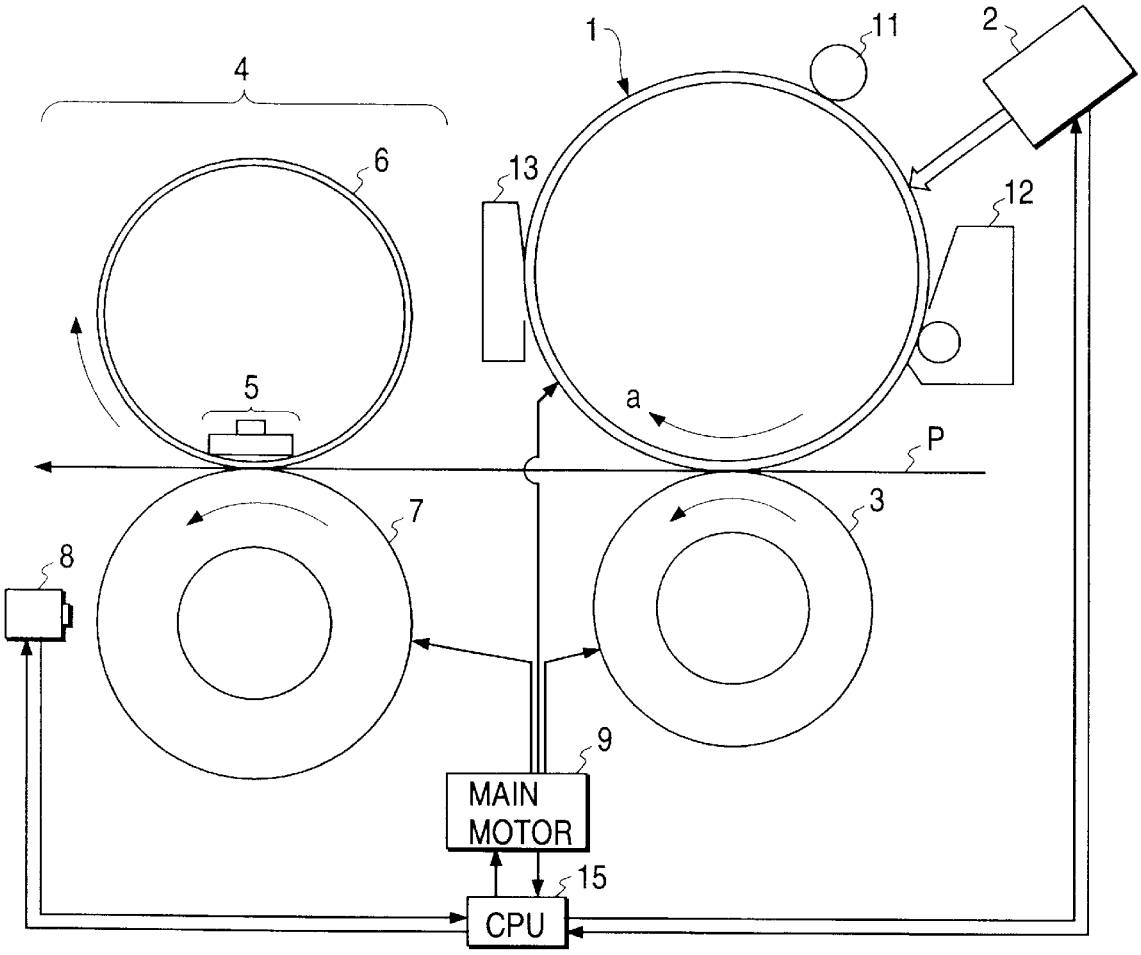
FIG. 1 schematically shows the construction of an image forming apparatus which is a first embodiment of the present invention.

FIG. 1 is a schematic side view showing the image forming process portions of a copying apparatus or printer of the electrophotographic type according to a first embodiment.

In this embodiment, the rotation of a body main motor 9 which is a drive source is transmitted to a photosensitive drum 1, a transfer roller 3, a pressure roller 7, etc. through respective power transmitting mechanisms, not shown, and accordingly, when the rotational speed is decelerated, the photosensitive drum 1 and the pressure roller 7 are decelerated at the same deceleration ratio. Also, the photosensitive drum 1 and a charging device 11, a developing device 12 and a cleaning device 13 which are image process means disposed around the photosensitive drum 1 may be individually mounted on a printer body or may constitute a process cartridge made into a unit and interchangeably mounted on the printer body.

The photosensitive drum 1 which is an image bearing member is charged to uniform potential by the charging device 11 and a latent image is formed thereon by an exposure device 2. The latent image is then developed by the developing device 12 and the visualized toner image is transferred onto a recording medium P at a transfer position by the transfer roller 3 which is transfer means. The recording medium P onto which the toner image has been transferred is conveyed toward a fixing device 4 at a conveying speed obtained with the recording medium held between the photosensitive drum 1 and the transfer roller 3.

The fixing device 4 has a heater 5 disposed inside fixing film 6 of an endless shape, and the pressure roller 7 is in pressure contact with the heater 5 with the fixing film 6 interposed therebetween, and the recording medium P is conveyed therebetween at the peripheral velocity of the pressure roller 7. The pressure roller 7 is a rotatively driving member for imparting a conveying force to the recording medium. The heater 5 has a heat generating member (a resistance member) generating heat by being electrically energized.

The pressure roller 7 comprises a mandrel formed of a metal or the like and an elastic member of silicone rubber or the like formed on the outer periphery of the mandrel, and the elastic member has the property of being expanded by temperature and accordingly, the diameter of the pressure roller is changed by the rise of temperature.

Reference numeral 8 designates detecting means for detecting the peripheral velocity of the pressure roller 7, and more specifically a measuring device for measuring any change in the diameter of the pressure roller 7. As this measuring device 8, use is made, for example, of a sensor of the non-contact type using a laser Doppler system or of the contact type using an actuator, and this measuring device 8 outputs to a CPU 15 the diameter change information of the pressure roller 7 obtained.

The CPU 15 controls the rotation of the body main motor 9 on the basis of the measurement information from the measuring device 8 which measures any change in the diameter or the outer peripheral length of the pressure roller 7 of the fixing device 4. This control is to integrally control the speeds of the photosensitive drum 1, the transfer roller 3, the pressure roller 7, the developing roller of the developing device 12 and a paper supply mechanism, not shown, except the exposure device 2, and thus, when the body main motor 9 is decelerated, the speeds of these mechanisms are decelerated. The rate of this deceleration is set on the basis of the measurement information from the measuring device 8, and when for example, the process speed is 25 mm/sec. and the diameter of the pressure roller 7 at room temperature is 15.9 mm (the outer peripheral length is 50 mm and the peripheral velocity 25 mm/sec.), if the diameter or the outer peripheral length of the pressure roller is increased by 1%, the peripheral velocity of the pressure roller also increases by 1% (0.25 mm/sec.).

So, when the measuring device 8 detects any increase in the diameter or the outer peripheral length of the pressure roller, the CPU 15 controls the body main motor 9 so as to decelerate by the process speed corresponding to this increase (in this case, 0.25 mm/sec.), thereby decelerating the process speed.

At that time, the exposure device 2 executes exposure while maintaining an exposure process speed of a predetermined magnification set independently of the above-described deceleration of the process speed. Therefore, the latent image formed on the photosensitive drum 1 is formed while shrinking in the direction of rotation of the drum 1. That is, the exposure device 2 forms an image on the photosensitive drum 1 at the above-mentioned process speed of 25 mm/sec., whereas the image on the photosensitive drum 1 shrinks by 1% in the direction of rotation because the photosensitive drum 1 is decelerated by 1% relative to the exposure process speed.

On the other hand, the rotational speed of the pressure roller 7 of the fixing device 4 is decelerated in conformity with the deceleration of the body main motor 9, but the peripheral velocity of the pressure roller 7 is higher than the transfer speed.

The transfer unit and the fixing unit are proximate to each other, and the recording medium being subjected to image transfer in the transfer unit is conveyed by the pressure roller.

Thus, the recording medium P supplied from a paper supply cassette, not shown, toward the transfer position at a decelerated supply speed and having had a toner image transferred thereto by the transfer roller 3 is conveyed depending on the peripheral velocity of the pressure roller 7, and slips relative to the toner image on the photosensitive drum 1. Thus, the toner image is transferred onto the recording medium P while being elongated in the direction of conveyance. However, the toner image is formed while being shrinked relative to the direction of conveyance and therefore, the image elongated by the above-mentioned slip becomes an image of just a regular size, and it never happens that the toner image is transferred onto up to the trailing end of the recording medium P with respect to the direction of conveyance.

That is, assuming that by the pressure roller 7, the recording medium P is conveyed faster by 1% relative to the peripheral velocity of the photosensitive drum 1, the toner image is transferred longer by 1% in the direction of conveyance when transferred from the photosensitive drum 1 to the recording medium P, but the toner image on the photosensitive drum 1 is shrinked by 1% and therefore, the toner image transferred onto the recording medium P while being elongated assumes just a regular lengthwise and widthwise size. Thus, the image after transferred onto the recording medium is not affected by the elongation of the image due to the expansion of the pressure roller.

Figure 2:
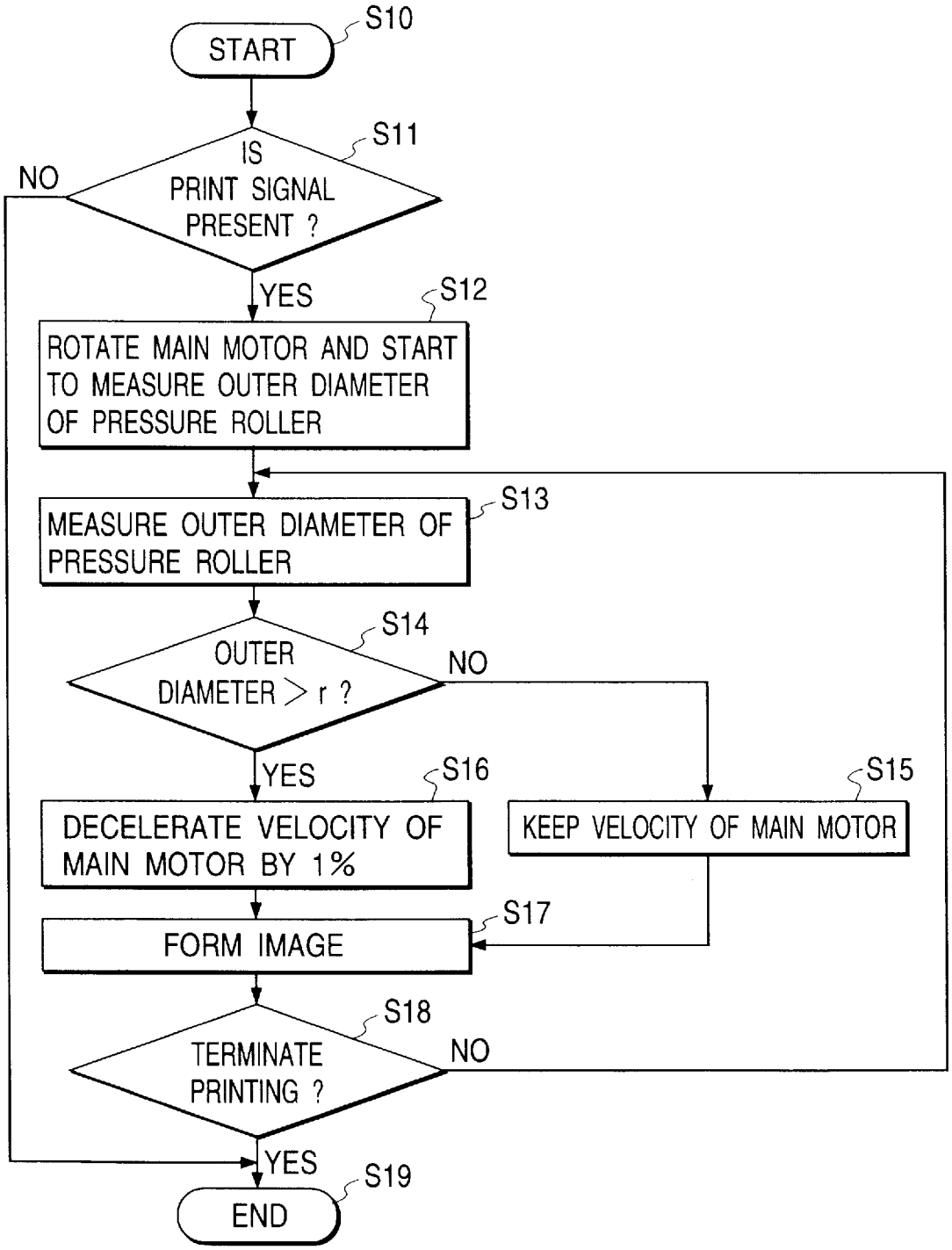
FIG. 2 is a flow chart showing the operation of the first embodiment.

The operation of the present embodiment will now be described with reference to a flow chart shown in FIG. 2.

At a step (abbreviated as S) 10, the main flow starts, for example, upon closing of a main power source switch, and at S11, the presence or absence of a print signal (an image formation starting signal) is monitored, and if there is not the print signal, for example, for a predetermined time, advance is made to S19, where the main flow is ended. Also, when the print signal is received, the body main motor 9 is rotated at S12 and the charging of the photosensitive drum 1 is started by the charging device 11 and at the same time, the developing device 12 and the transfer roller 3 are also driven to thereby develop the latent image formed by the exposure device 2, and the thus developed toner image is transferred to the recording medium P. Also, after the print signal has been received, the electrical energization of the heater 5 is started. At the same time, the measurement of the outer diameter of the pressure roller 7 is started by the measuring device 8, and advance is made to S13.

When at S13, the measurement of the outer diameter of the pressure roller 7 is terminated, at S14, comparison between the measured outer diameter value and a predetermined value γ is done, and if the measured outer diameter value is smaller than the predetermined value γ (no), the recording medium conveying speed of the fixing device 4 by the pressure roller 7 is not too great and therefore, advance is made to S15, where the current velocity of the body main motor 9 is kept without being changed, and advance is then made to S17, where image formation is started. The image formation at S17 refers to a series of transferring and fixing operations.

On the other hand, if at S14, it is judged that the measured value is greater than the predetermined value γ, it is judged that the peripheral velocity of the pressure roller 7 has increased, and advance is made to S16, where the rotational speed of the body main motor 9 is decelerated at a predetermined rate. In the above-described example, speed control for decreasing the rotational speed of the body main motor 9 by 1% is effected. By this speed control, the formation of a latent image is shrinked in the direction of rotation. Thereafter, advance is made to S17, where the above-described image formation is started, and advance is made to S18.

At S18, whether the printing operation is to be continuedly performed is judged, and if printing is to be continuedly effected, return is made to S13, and if printing is to be terminated, advance is made to S19, where the main operation is ended.

Thus, according to the present embodiment, even if the pressure roller is expanded by the temperature rise of the fixing device and the conveyance speed of the recording medium during transfer becomes higher than the process speed, the process speed of image formation is changed and for example, an image shrinked in the direction of movement of the image bearing member is formed, whereby in a regular image state, an unfixed image can be transferred onto the recording medium conversely by the utilization of transfer deviation occurring due to the speed difference.

(Second Embodiment)

Figure 3:
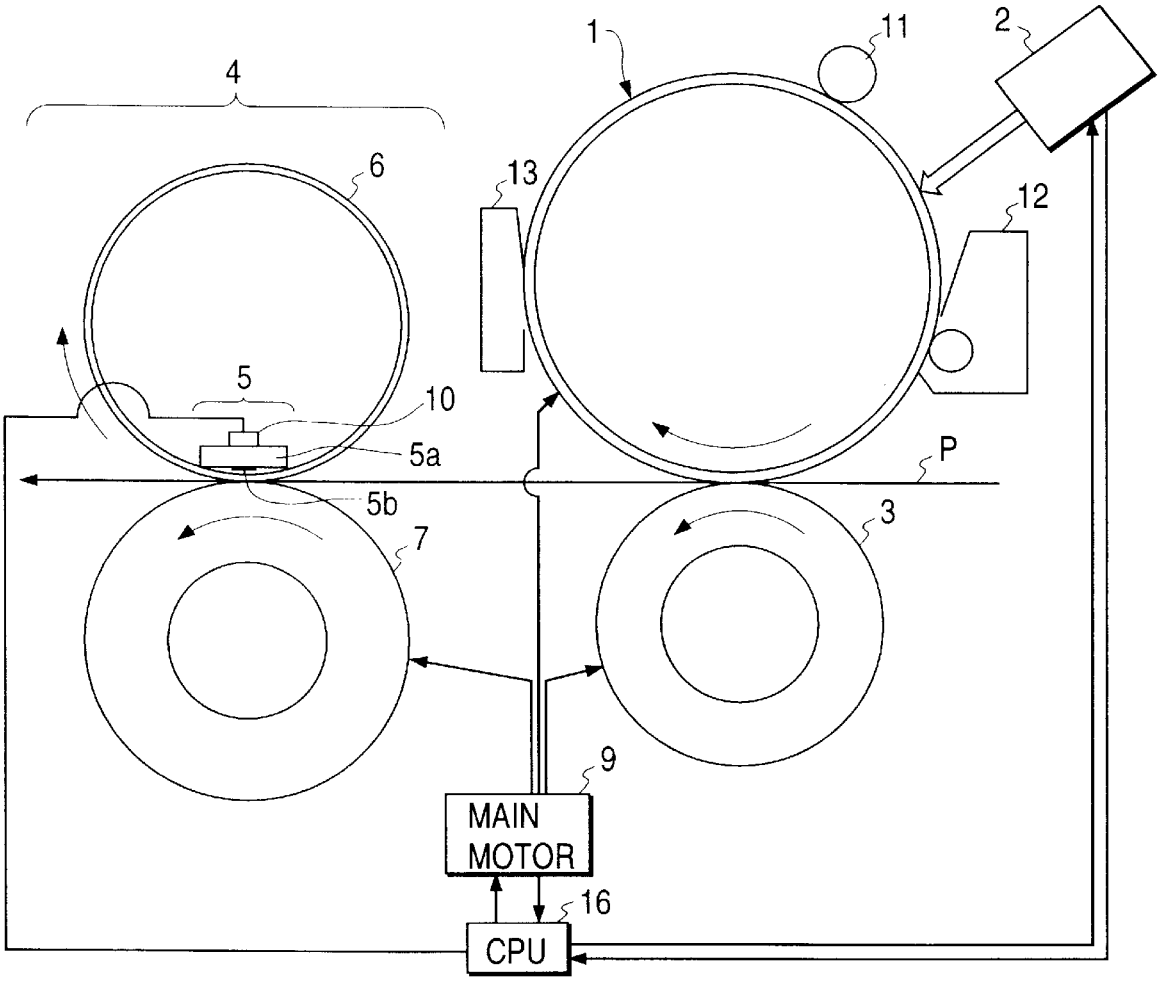
FIG. 3 schematically shows the construction of an image forming apparatus which is a second embodiment of the present invention.

FIG. 3 is a schematic view of a printer showing a second embodiment.

In the above-described first embodiment, the outer diameter of the pressure roller 7 of the fixing device 4 is measured by the measuring device 8 and control is effected so that the rotational speed of the main motor 9 may be decreased when the outer diameter is such that the conveyance speed of the recording medium P by the fixing device 4 affects the transfer speed, while in the present embodiment, any change in the diameter of the pressure roller 7 by the thermal expansion thereof is foreseen from the controlled temperature of the heater 5 of the fixing device 4 and as in the first embodiment, the rotation control of the body main motor 9 is effected.

In FIG. 3, as regards the heater 5, a heat generating member 5*b* is disposed on one side of an insulative substrate 5*a* and a temperature detecting element 10 is disposed on the side thereof which is opposite to the pressure roller 7, and the electrical energization control of the heater is executed by a CPU 16 while the temperature of the heater is being monitored by the temperature detecting element 10, and the heater is maintained at a predetermined control temperature. Usually, the control temperature is set to a low level when the temperature of the fixing device is high, and the control temperature is set to a high level when the temperature of the fixing device is low.

In the case of the fixing device 4 of the film heating type, the temperature of the pressure roller 7 depends on the control temperature of the heater 5, and as a method of controlling the temperature of the heater 5, there is conceivable a method of determining the control temperature by the number of recording mediums fed, or a method of detecting the temperature of the heater 5 or the pressure roller 7 each time a recording medium passes, and determining the control temperature, and in any of these methods, the relation between the control temperature of the heater 5 and the temperature (thermal expansion) of the pressure roller 7 is measured in advance and is stored in a memory.

Figure 4:
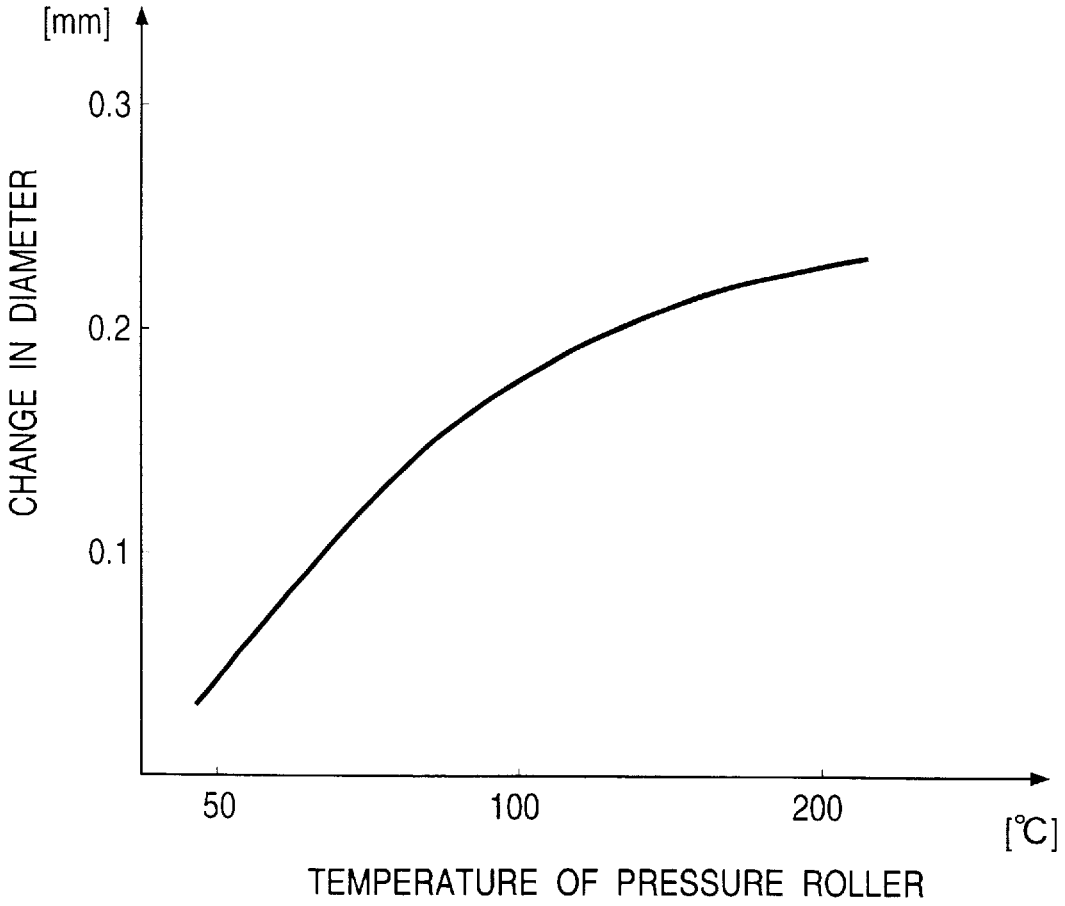
FIG. 4 is a graph showing the relation between the temperature and the change in the diameter of a pressure roller.

The pressure roller 7 used in the present embodiment comprises a metallic mandrel covered with silicone rubber, and the thermal expansion of the pressure roller 7 depends on the thermal expansion of the silicone rubber, and for example, in the case of a pressure roller having a diameter of 30 mm and having the thickness of rubber of 10 mm, the relation between the temperature and a change in the diameter of the pressure roller is such as shown in FIG. 4.

In the present embodiment, when the control temperature of the heater 5 is high, the temperature of the fixing device 4 is low and therefore, the temperature of the pressure roller 7 can be said to be also low. Consequently, the pressure roller 7 can be said to be not thermally expanded, and the driving of the body main motor 9 is controlled at the ordinary process speed. In contrast, when the control temperature of the heater is low, the temperature of the pressure roller 7 is high and the pressure roller is in its thermally expanded state and therefore, as in the first embodiment, the process speeds of the other elements than the exposure device are decelerated.

In the present embodiment, any change in the diameter of the pressure roller 7 can be detected by the use of the temperature detecting element 10 mounted on the heater 5 in advance, and the measuring device as in the first embodiment is unnecessary. That is, the temperature detecting element 10 is detecting means for detecting the peripheral velocity of the pressure roller.

When there are several stages in the control temperature of the heater 5, any change in the diameter of the pressure roller is measured in advance and the process speed is changed into several stages, and this is more effective.

Figure 5:
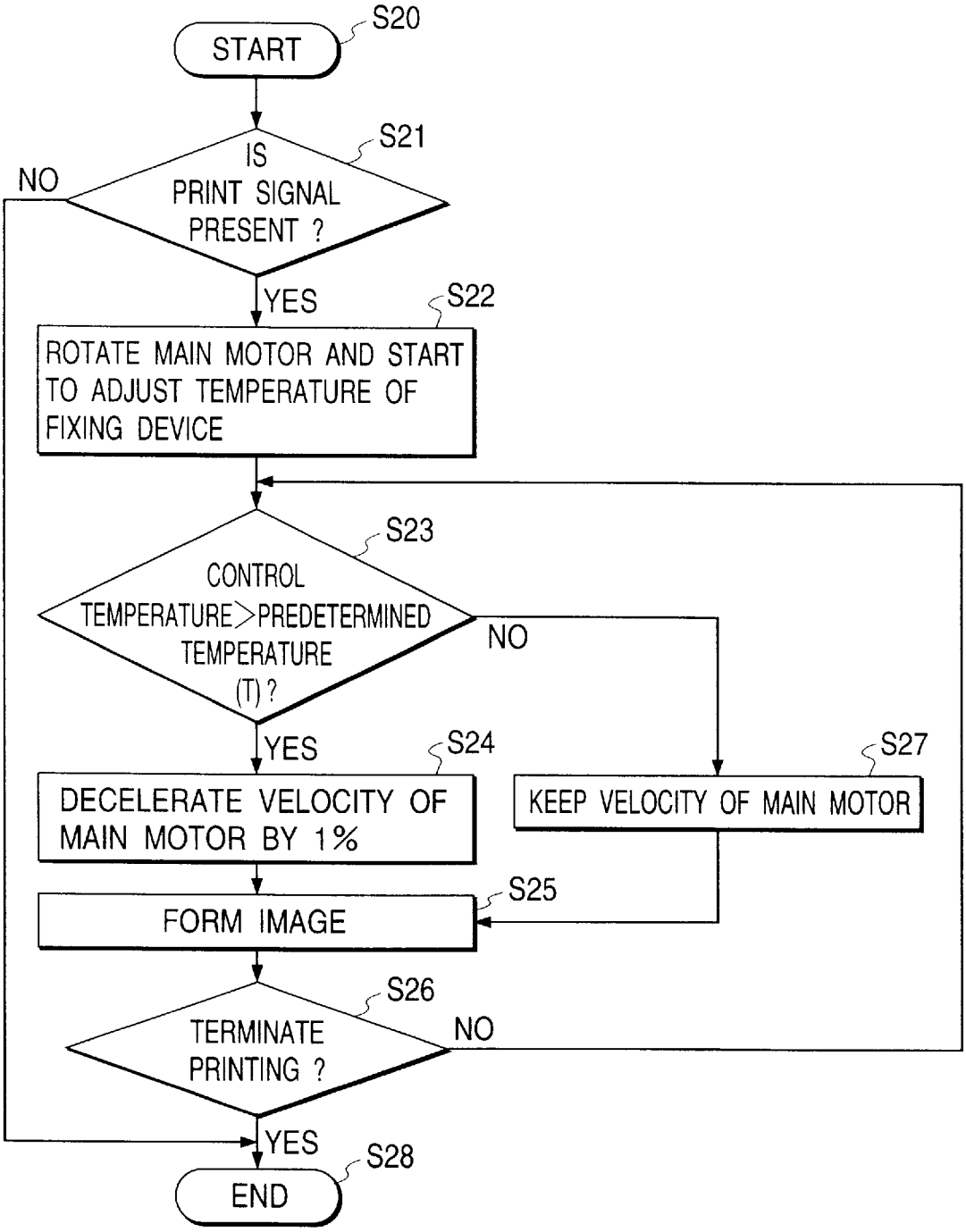
FIG. 5 is a flow chart showing the operation of the second embodiment.

The operation of the present embodiment will now be described with reference to a flow chart shown in FIG. 5.

At a step (abbreviated as S) 20, the main flow starts, for example, upon closing of a main power source switch, and at S21, the presence or absence of a print signal is monitored, and if the print signal is not present for example, for a predetermined time, advance is made to S28, where the main flow is ended. Also, when the print signal is received, at S22, the body main motor 9 is rotated and the charging of the photosensitive drum 1 is started by the charging device 11 and at the same time, the developing device 12 and the transfer roller 3 are driven, and the latent image formed by the exposure device 2 is developed and the thus developed toner image is transferred onto the recording medium P and at the same time, the electrical energization of the fixing device 4 is started to thereby start temperature adjustment, and advance is made to S23.

At S23, the control temperature based on the temperature detected by the temperature detecting element 10 is compared with a predetermined temperature T, and if the control temperature is lower than the predetermined temperature T (no), the thermal expansion of the pressure roller 7 is not great and therefore, the recording medium conveying seed of the fixing device 4 by the pressure roller 7 is not too great and therefore, advance is made to S27, where the current speed of the body main motor 9 is kept without being changed, and advance is made to S25, where image formation is started. The image formation at S27 refers to a series of transferring and fixing operations.

On the other hand, if at S23, it is judged that the control temperature is greater than the predetermined temperature T, it is judged that the peripheral velocity of the pressure roller 7 has increased, and advance is made to S24, where the rotational speed of the body main motor 9 is decelerated at a predetermined rate. In the above-described example, speed control for decreasing the rotational speed of the body main motor 9 by 1% is effected. By this speed control, the formation of the latent image is shrinked in the direction of rotation. Thereafter, advance is made to S25, where the above-described image formation is started, and advance is made to S26.

At S26, whether the printing operation is to be continuedly performed is judged, and if printing is to be continuedly effected, return is made to S23, and if printing is to be terminated, advance is made to S28, where the main operation is ended. Again in the present embodiment, there can be obtained an effect similar to that of the aforedescribed embodiment.

(Third Embodiment)

In the above-described first and second embodiments, the control for decreasing the rotational speed of the body main motor 9 can be executed in the course of printing or from the initial stage of printing.

However, if there is not a discrete sequence of pre-rotation in the case of the control system in which the control is executed from the initial stage of printing, the application timing of a high voltage for the uniform charging by the charging device 11 will be deviated by the deceleration of the photosensitive drum 1 and lateral black band-like toner fog will be created on the image or the back of the recording medium or the interior of the apparatus will be contaminated.

So, it is also possible to set the sequence of pre-rotation correspondingly to each deceleration, but this is not preferable because it requires many memories and is not only uneconomical but is apt to cause a bug.

Also, when the control of the rotation of the body main motor 9 is executed in the course of printing, if the rotational speed of the photosensitive drum 1 changes in the course of the charging by the charging device 11, it is also conceivable that a level difference is created in the potential of the dark portion of the photosensitive member to thereby create light and shade.

In the present embodiment, the sequence of application of a high voltage to the circumference of the photosensitive drum is carried out at a single speed, and the basic layout is made similar to that in the first and second embodiments, and the difference of the present embodiment from the first and second embodiments is that during the pre-rotation, the high voltage of the charging device 11 is started and is made stable in the state of the highest rotational speed. Thereafter, as required, the speed of the photosensitive drum is reduced and image exposure is started.

Now, in the image formation by the electrophotographic method, high voltage generating means for applying high voltages in succession to the photosensitive drum, such as a charging roller which is a charging device, a developing device and a transfer roller are disposed around a photosensitive drum and these high voltage generating means are usually set so as to rise within 100 msec.

However, for example, at a process speed of 25 mm/sec., even a deviation of 10 msec. results in a deviation of 0.25 mm and if this is present as fog on recording paper, it will be conspicuous sufficiently as a black line.

In the present embodiment, a high voltage for the charging by the charging device is started from the start of the rotation of the photosensitive drum and the charged potential of the photosensitive drum is once stabilized, and then the rotational speed of the photosensitive drum is delayed to a proper level, and image exposure is started.

More preferably, the rotational speed of the photosensitive drum is changed and after the potential of the dark portion on the drum has become stable, image exposure is started.

Usually, when the rotational speed of the photosensitive drum is low, the potential of the dark portion does not greatly change for a speed change of the order of 1–3% and therefore, there is no problem. However, when the rotational speed of the photosensitive drum is 40 mm/sec. or higher or when the speed change is as great as 3% or more, a change in the potential of the dark portion may sometimes occur on the photosensitive drum and appear as the light and shade on the image. Accordingly, it is effective for keeping the uniformity of the density of the image to start image exposure after the potential of the dark portion of the photosensitive drum is once stabilized.

Also, when the speed of the photosensitive drum is changed in the course of continuous printing, it is preferable to effect image exposure after image exposure is once stopped and the charged potential of the dark portion is stabilized.

For this purpose, paper supply may be once stopped immediately before the speed of the photosensitive drum is changed over, and the photosensitive drum may be idly rotated while being charged, to thereby stabilize the potential for a new speed. This is also effective in that no bur is created on the image.

In the above-described embodiment, the potential of the photosensitive member is constant, but alternatively, the set potential may be changed at the same time when the speed of the drum is changed. Of course, the setting of the high voltage for charging, development and transfer may also be changed at the same time when the speed is changed, to thereby provide proper density and prevent fogging.

Figure 6:
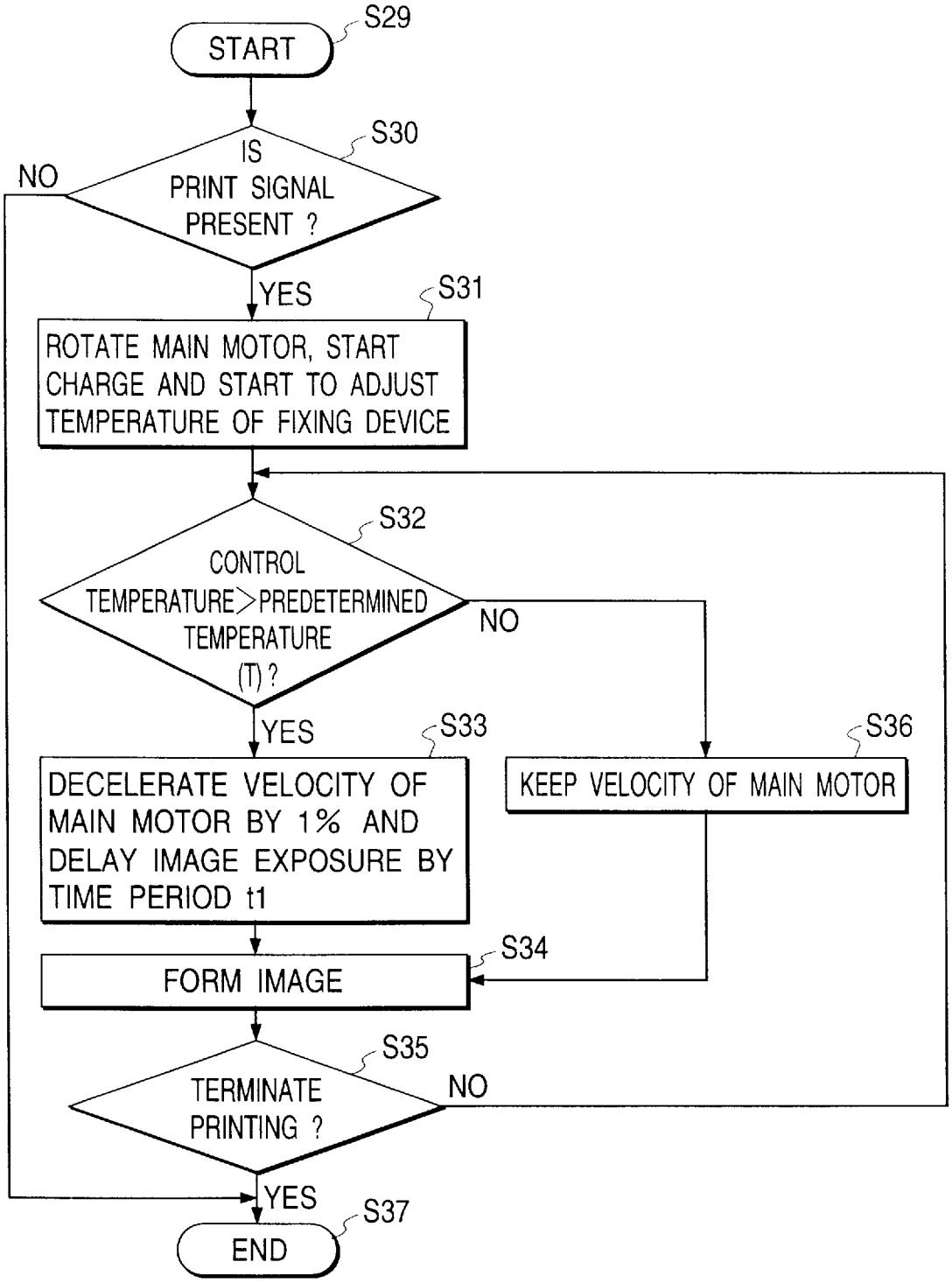
FIG. 6 is a flow chart showing the operation of a third embodiment.
Figure 7:
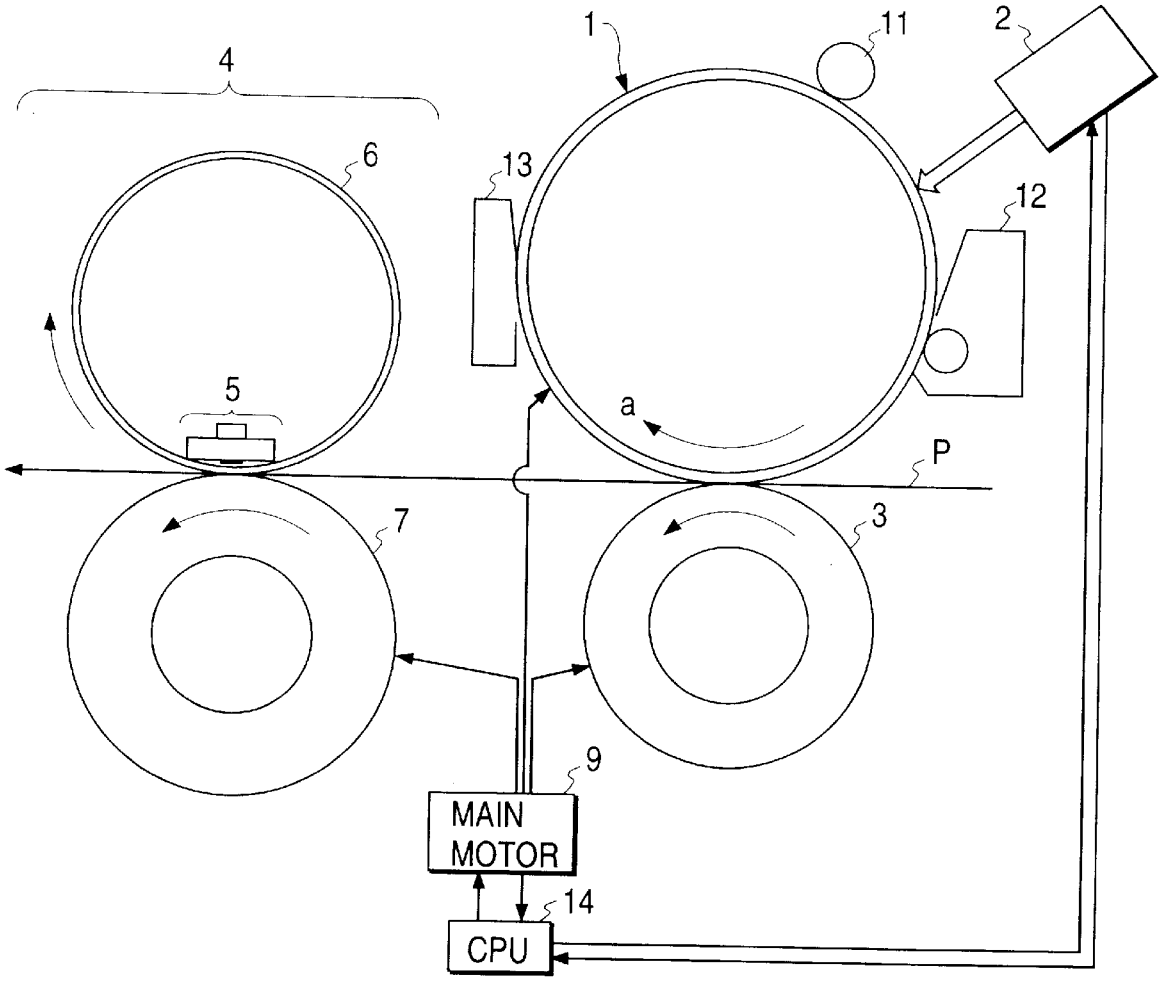
FIG. 7 schematically shows the construction of an image forming apparatus which is the background art of the present invention.
Figure 8:
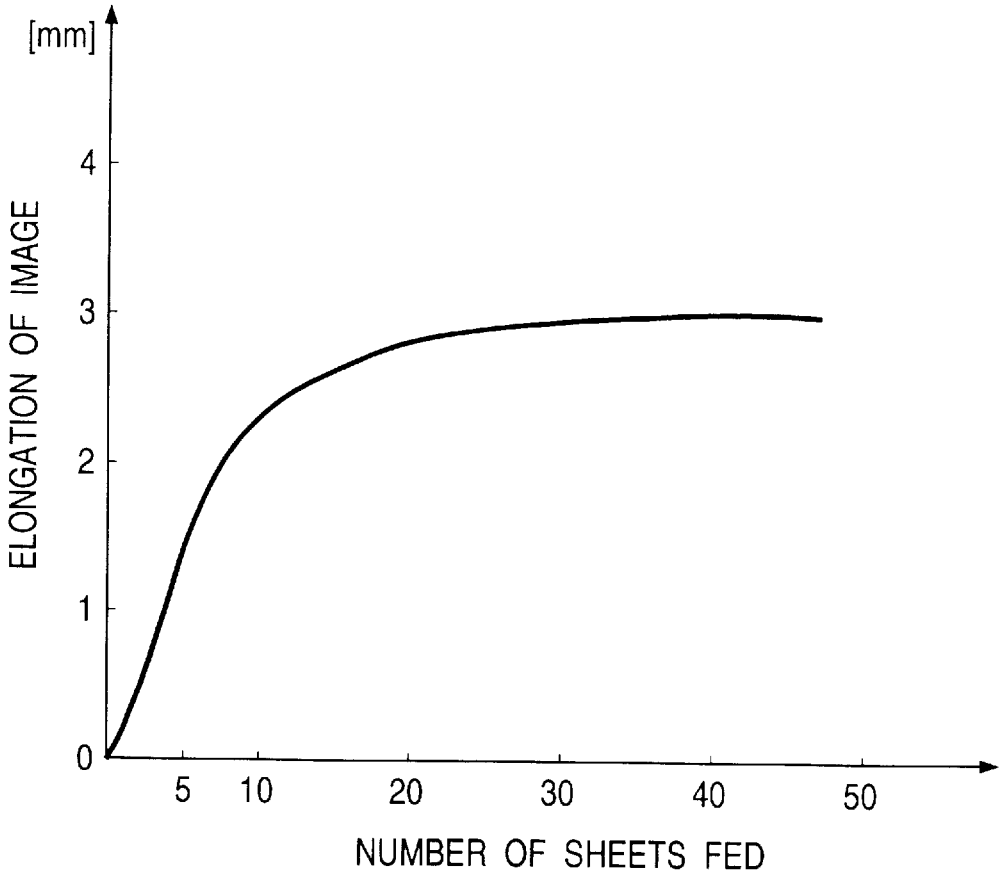
FIG. 8 is a graph showing the relation between the number of recording mediums on which images are formed and the elongation of image.

The operation of the present embodiment will now be described with reference to a flow chart shown in FIG. 6. The basic construction of the printer of the present embodiment is similar to that of the second embodiment shown in FIG. 3.

At a step (abbreviated as S) 29, the main flow starts, for example, upon closing of a main power source switch, and at S30, the presence or absence of a print signal is monitored, and if there is not the print signal, for example, for a predetermined time, advance is made to S37, where the main flow is ended. Also, when the print signal is received, at S31, the body main motor 9 is rotated and the charging of the photosensitive drum 1 is started by the charging device 11, and also the temperature adjustment of the fixing device 4 is started, and advance is made to S32.

At S32, the control temperature based on the temperature detected by the temperature detecting element 10 is compared with the predetermined temperature T, and if the control temperature is lower than the predetermined temperature T (no), the thermal expansion of the pressure roller 7 is not great and therefore, the recording medium conveying speed of the fixing device 4 by the pressure roller 7 is not too great and therefore, advance is made to S36, where the current speed of the body main motor 9 is kept without being changed, and advance is made to S34, where image formation is started. The image formation at S34 refers to a series of latent image forming developing, transferring and fixing operations.

On the other hand, if at S32, it is judged that the control temperature is greater than the predetermined temperature T, it is judged that the peripheral velocity of the pressure roller 7 has increased, and advance is made to S33, where the rotational speed of the body main motor 9 is decelerated at a predetermined rate, and in accordance therewith, the start of the exposure by the exposure device is delayed by a time t, and the stabilization of the potential of the dark portion is waited for and exposure is started, and advance is made to S34. In the above-described example, speed control for decreasing the rotational speed of the body main motor 9 by 1% is effected. Here, after the changeover of the speed by this speed control is effected, the latent image forming and subsequent image forming processes are executed, whereby the blur of the image and the fogging by the irregularity of charging can be prevented. As in the second embodiment, the formation of the latent image is shrinked in the direction of rotation. Thereafter, advance is made to S35, where whether the printing operation is to be continuedly performed is judged, and if printing is to be continuedly effected, return is made to S32, and if printing is to be terminated, advance is made to S32, where the main operation is ended.

Again in the present embodiment, there can be obtained an effect similar to that of the aforedescribed embodiments.

Description will now be made of an embodiment in which the vibration of image is further prevented even if the process speed is changed over.

(Fourth Embodiment)

(1) General Construction of the Image Forming Apparatus

Figure 9:
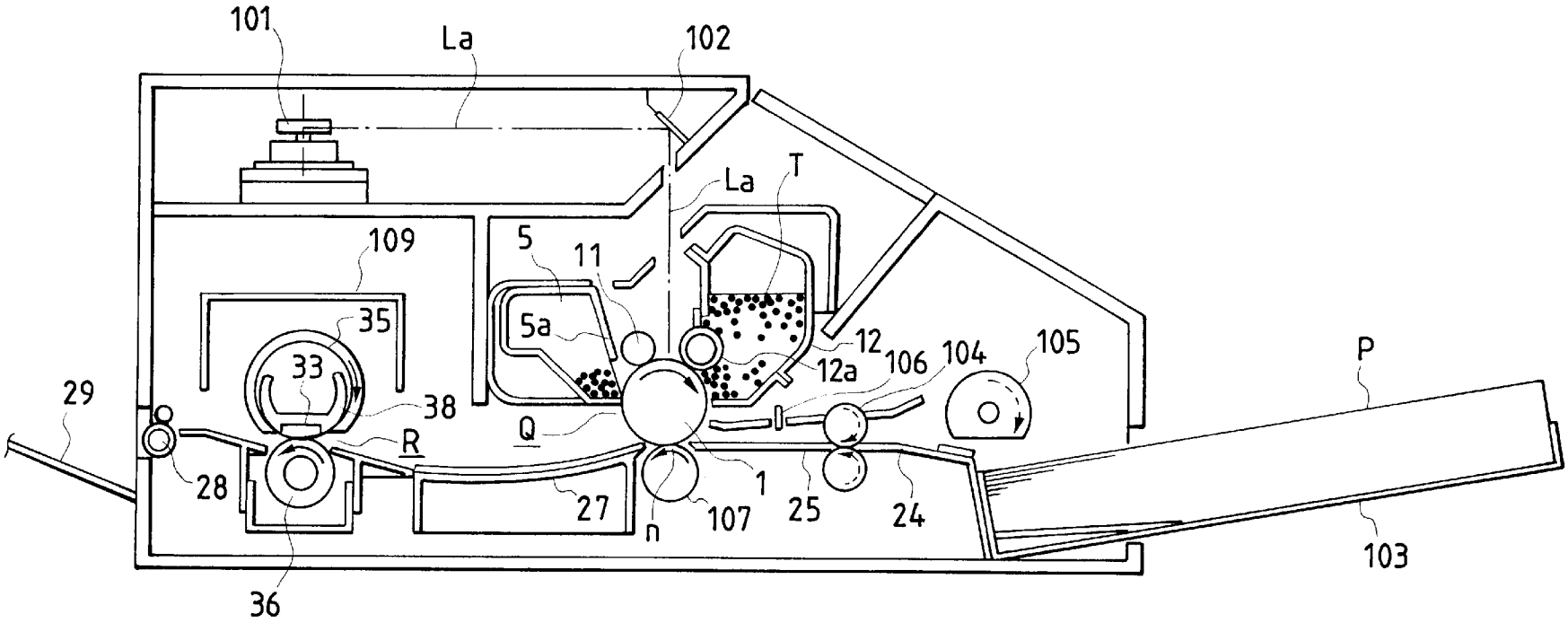
FIG. 9 schematically shows the construction of an image forming apparatus which is a fourth embodiment of the present invention.
Figure 10:
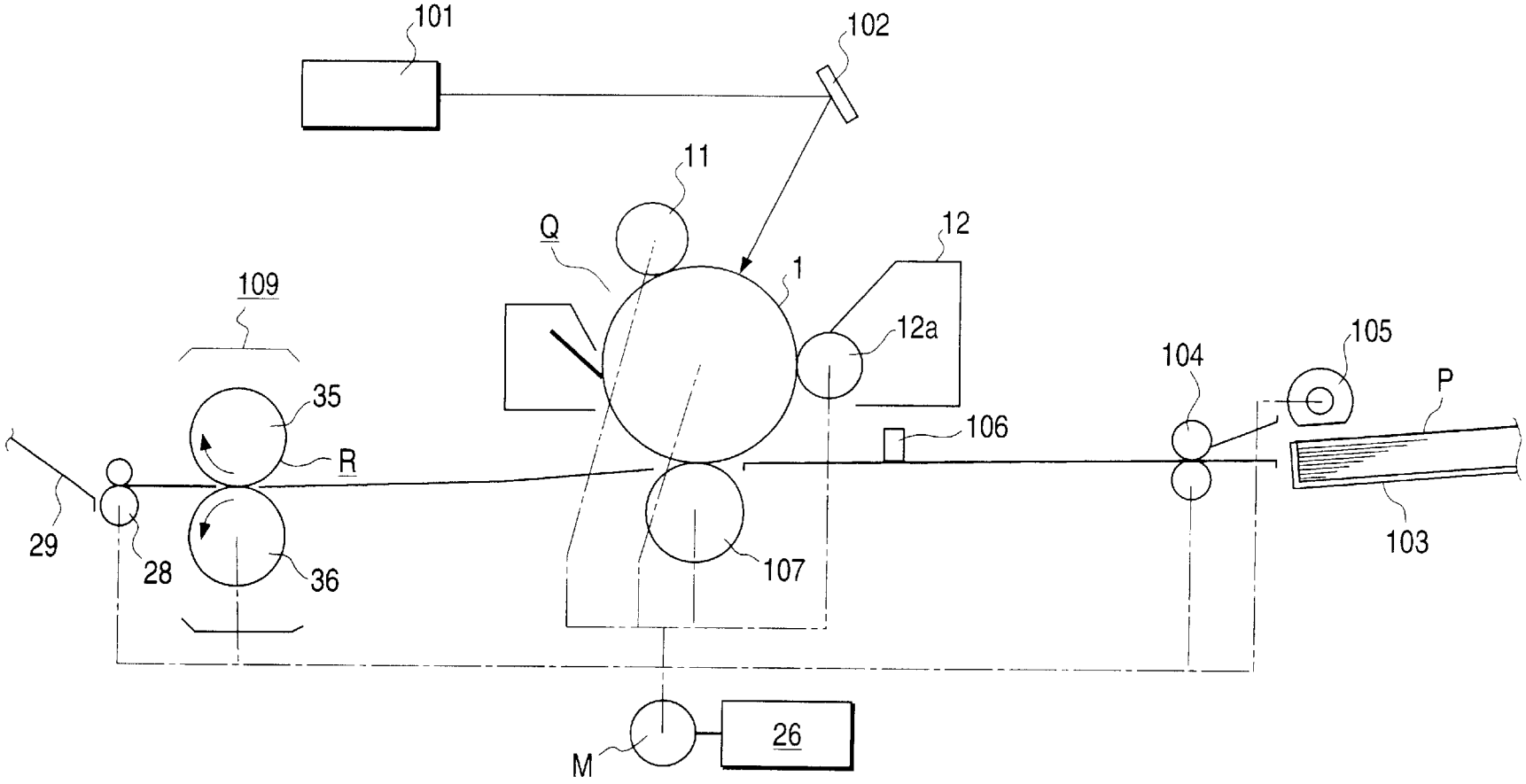
FIG. 10 shows the driving system of the fourth embodiment.

FIG. 9 is a schematic view of an example of the image forming apparatus, and FIG. 10 is a model view showing the driving system of the apparatus. The image forming apparatus of this embodiment is a laser beam printer utilizing the electrophotographic process of the transfer type.

Reference numeral 1 designates an electrophotographic photosensitive member of a rotatable drum type as an image bearing member. This photosensitive member 1 is rotatively driven at a predetermined peripheral velocity (process speed) in the clockwise direction of arrow, and is uniformly charged to predetermined minus dark potential VD by a primary charger 11 in the process of rotation thereof.

Reference numeral 101 denotes a laser beam scanner which applies a laser beam La modulated correspondingly to the time-serial electrical digital pixel signal of desired image information inputted from a host apparatus such as an image reading apparatus, a word processor or a computer, not shown, onto the surface of the photosensitive member 1 via a turn-back mirror 102. The surface of the photosensitive member 1 uniformly charged to minus by the primary charger 11 as previously described is scanned and exposed by the laser beam La, whereby the exposed portion becomes small in the absolute value of the potential and assumes light potential $V_L$, and an electrostatic latent image corresponding to the desired image information is formed on the surface of the rotatable photosensitive member 1.

The latent image is then reversely developed by a powdered toner T as a recording agent charged to minus by a developing device 12.

The developing device 12 has a rotatively driven developing sleeve 12*a*, the outer peripheral surface of which is coated with a thin layer of the toner T having minus charges and is opposed to the surface of the photosensitive member 1, and a developing bias voltage $V_{DC}$ having an absolute value smaller than the dark potential $V_D$ of the photosensitive member 1 and greater than the light potential $V_L$ of the photosensitive member 1 is applied to the sleeve 12*a*, whereby the toner on the sleeve 12*a* is transferred to only the portion of the light potential $V_L$ of the photosensitive member 1 and the latent image is visualized (reversely developed).

On the other hand, recording mediums P piled on a paper supply cassette 103 are fed out one by one by a pickup roller 105, and are fed via a conveying guide 24, a pair of register rollers 104 and a pre-transfer guide 25 to the nip portion (transfer portion) n between the photosensitive member 1 and a transfer roller 107 as transfer means bearing against it and having a transfer bias applied thereto by a power source (not shown), at appropriate timing synchronized with the rotation of the photosensitive member 1. At this time, the recording medium P as it is conveyed along the pre-transfer guide 25 is detected by a top sensor 106 and as will be described later in detail, exposure, developing bias, transfer bias, etc. are controlled at appropriate timing.

The toner image on the surface of the photosensitive member 1 is sequentially transferred to the surface of the recording medium P thus fed.

The recording medium P which has passed through the transfer portion n is separated from the surface of the photosensitive member 1, is introduced into a fixing device 109 by a conveying guide 27 and is subjected to the fixation of the transferred toner image, and then is conveyed by paper discharge rollers 28 and is outputted as an image-formed article (print) onto a paper discharge tray 29.

After the separation of the recording medium, the surface of the photosensitive member 1 has any residual such as untransferred toner removed therefrom by the cleaning blade 13*a* of a cleaning device 13 and is cleaned thereby for repetitive image formation.

(2) Driving System (Recording Medium Conveying System)

FIG. 10 is a model view showing the driving system of the apparatus of the present embodiment. In FIG. 10, the letter M designates a main motor which is drive-controlled by a printer control unit 26.

Figure 11:
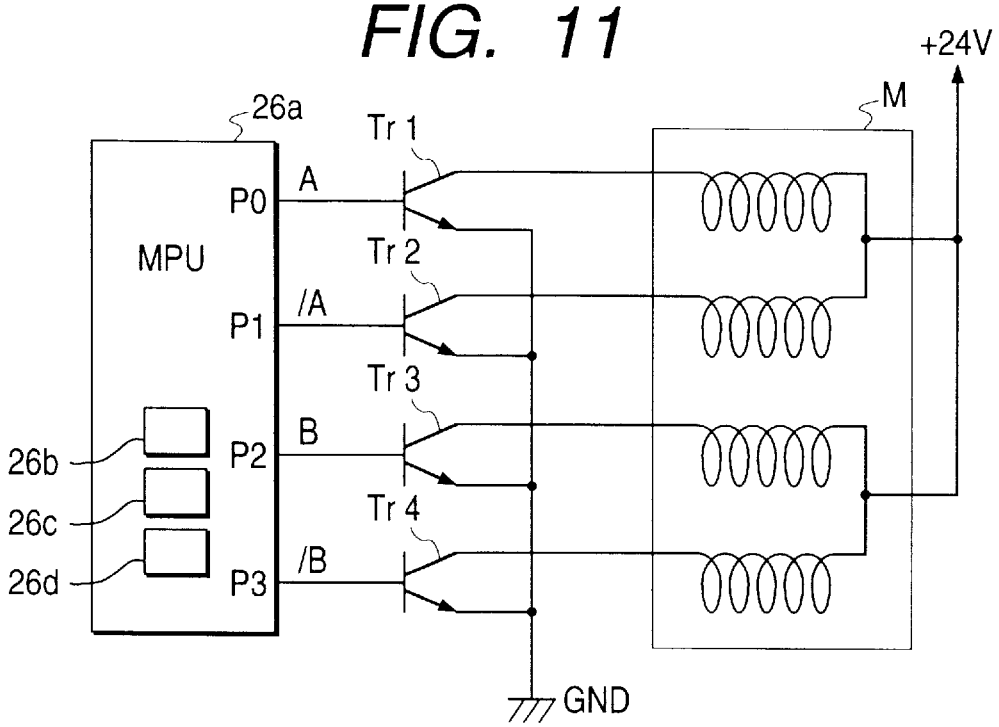
FIG. 11 is a circuit diagram regarding the driving of a main motor.

FIG. 11 is a circuit diagram of that portion of the printer control unit 26 which is concerned in the driving of the main motor M.

In FIG. 11, the reference character 26*a* denotes a one-chip microcomputer provided with a ROM 26*b*, a RAM 26*c* and a timer 26*d*. The main motor M is a four-phase stepping motor, of which one end of the windings of A phase, /A phase, B phase and /B phase is connected to the collectors of NPN transistors Tr1, Tr2, Tr3 and Tr4, and the other ends of the windings are connected to +24 V power source. The emitters of the NPN transistors TR1, Tr2, Tr3 and Tr4 are connected to GND, and the bases thereof are connected to the output ports P0, P1, P2 and P3 of the MPN. A surge absorbing diode for protecting each NPN transistor is not shown in FIG. 11.

Figure 12:
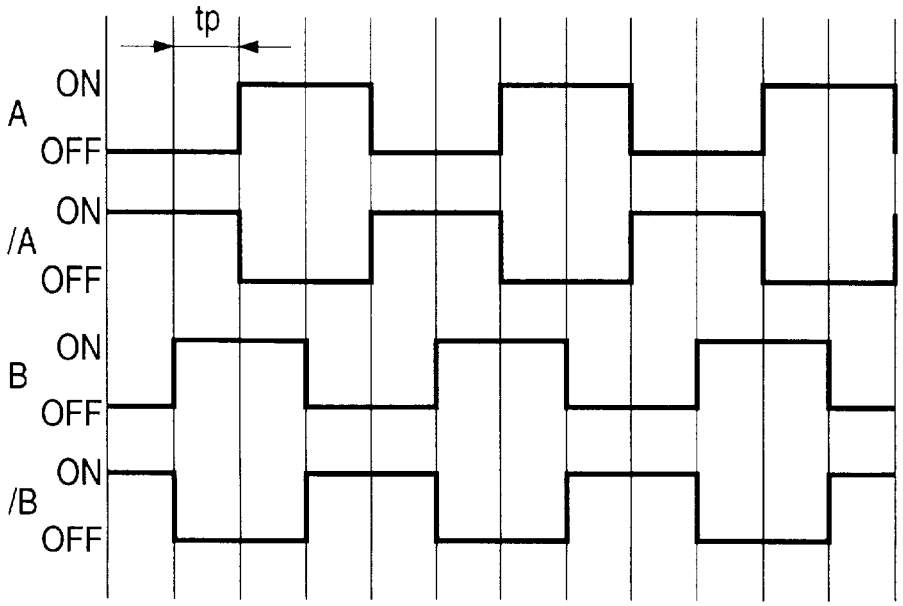
FIG. 12 is a timing chart showing an excitation pulse for the driving of the main motor.

FIG. 12 is a timing chart showing an excitation pulse for driving the main motor M. When the main motor M is to be rotated, the MPU 26*a* calculates the frequency of the excitation pulse by the use of the timer 26*d* contained therein, and outputs excitation pulses of A phase, /A phase, B phase and /B phase at predetermined frequencies from the output ports P0, P1, P2 and P3. By changing the frequencies of the excitation pulses, the rotational speed of the motor M can be changed.

By the driving of the main motor M, elements 104, 105, 107, 1, 11, 12*a*, 36 and 28 as the driving system (recording medium conveying system) are collectively driven through power transmitting systems (indicated by dot-and-dash lines in FIG. 10) such as suitable gears and clutches, and as described above, the conveyance of the recording medium P, the transfer of the toner image and the heating and fixation of the toner image are effected in liaison with one another.

Thus, if for example, the printer control circuit 26 increases the frequency of the excitation pulse, the rotation of the motor M will become fast and the conveying speed of the recording medium P will become high. If conversely, the frequency is decreased, the rotation of the motor M will become show and the conveying speed of the recording medium P will become low.

(3) Image Heating and Fixing Device 109

Figure 13:
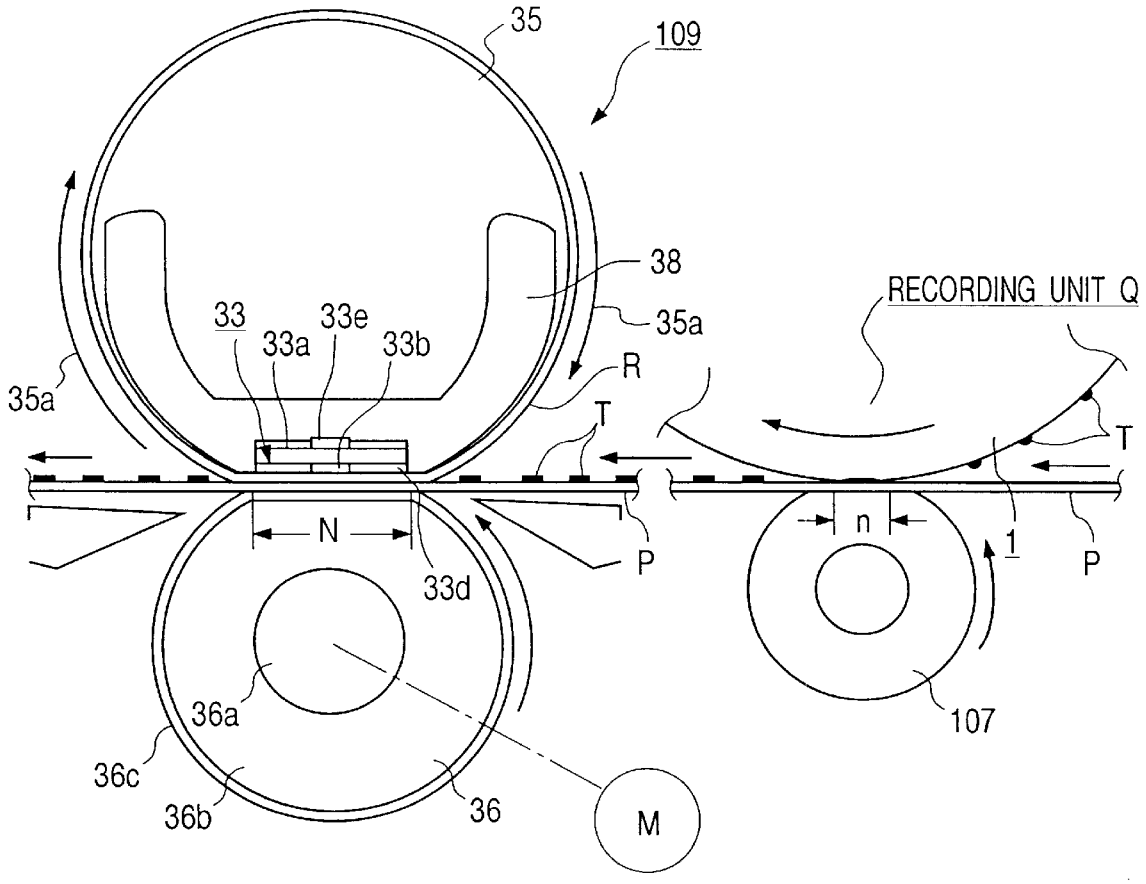
FIG. 13 shows the construction of a fixing device.
Figure 14:
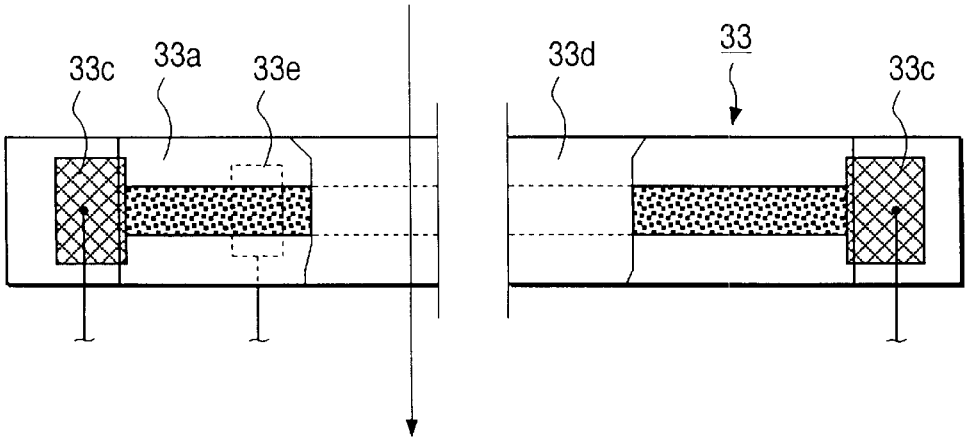
FIG. 14 shows the construction of a heater.

FIG. 13 is a schematic cross-sectional view schematically showing the construction of a fixing device in the present embodiment, and FIG. 14 is a partly cut-away model view of the heating member (the halfway portion of which is not shown) of this fixing device. The device in this embodiment is of the film heating type.

Reference numeral 38 designates a film inner surface guide member of a semicircular cross-sectional trough shape. A heating member fit-in groove is formed in the substantially central portion of the underside of the outer side of this guide member 38 along the length of this member, and a low heat capacity linear heating member 33 is fitted in and supported by this groove.

A pressure roller 36 is urged against or press-contacted with an assembly (heating member) R comprising cylindrical heat-resisting film 35 loosely fitted on the film inner surface guide member 38 with the heating member 33.

This pressure roller 36 is rotatively driven as a drive roller by the driving system M, and the cylindrical film 35 is rotatively driven about the film inner surface guide member 38 with the inner surface of the cylindrical film 35 being brought into close contact with and slidden relative to the downwardly facing surface of the heating member 33 by the frictional force between the roller 36 and the outer surface of the film.

In this rotatively driven state of the film, the recording medium P is introduced between the film 35 and the pressure roller 36 and is passed through the fixing nip portion N, whereby the heating and fixation of the unfixed image are done.

The heating member 33, as shown in FIG. 13, is a linear heating member generally of a low heat capacity (ceramic heater) comprising an elongate substrate 33*a* such as heat resisting and insulative alumina of good heat conductivity having its length extending in a direction perpendicular to the conveyance direction 35*a* of the film 35, an electrically energizable heat generating member (resistance heat generating member) 33*b* such as Ag/Pb formed into a linear shape or a thin band-like shape along the length of the substrate on the substantially central portion in the widthwise direction of the surface side of the substrate by screen printing or the like, power supplying electrodes 33*c*, 33*c* such as Ag formed on the lengthwise opposite end portions of the electrically energizable heat generating member by screen printing or the like, an overcoat layer 33*d* such as heat resisting glass protecting the heating surface on which the electrically energizable heat generating member is formed, and a temperature detecting member 33*e* such as a thermistor for detecting the temperature of the heating member which is provided on the back of the substrate.

This heating member 33 is fixedly supported by a support member 34 with that surface thereof which is formed with the electrically energizable heat generating member 33*b* turned downwardly, and rises in temperature by the electrically energizable heat generating member 33*b* generating heat over the full length thereof by the supply of electric power to between the electrodes 33*c* and 33*c* on the opposite end portions, and the temperature rise is detected by the temperature detecting member 33*e*, and the detected temperature is fed back to a temperature control circuit (not shown), whereby the electrical energization of the electrically energizable heat generating member 33*b* is controlled so that the temperature of the heating member 33 may be maintained at a predetermined fixation temperature (control temperature).

Figure 16:
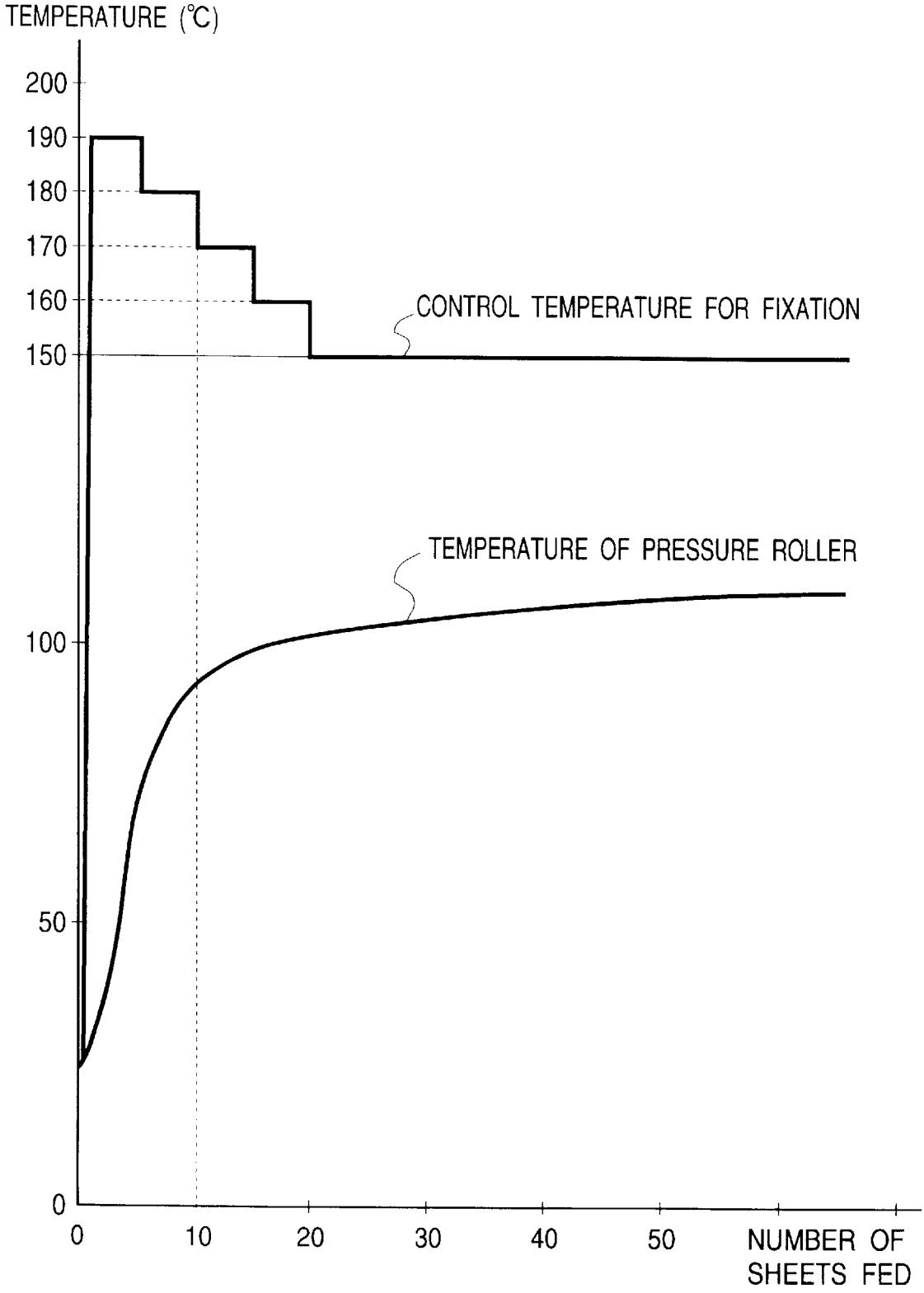
FIG. 16 is a graph showing the relation between the temperature of the pressure roller and the control temperature.

The temperature control by the temperature control circuit, as shown in FIG. 16, is accomplished by effecting multiple stages of temperature control conforming to a temperature change in the pressure roller 36, thereby maintaining fixativeness.

The heat resisting film 35 is thin film generally of a total thickness of 100 $\mu$m or less, and preferably 40 $\mu$m or less, excellent in heat resistance, parting property, durability, etc., and for example, film of PI (polyimide), polyether imide or the like.

The pressure roller 36 is an elastic roller comprising a roller mandrel, an elastic layer provided on the roller mandrel so that the surface of the roller may be able to be coated with fluorine resin such as FEP, PFA or PTFE excellent in parting property, and a fluorine resin layer including fluorine resin formed thereon, and sintered to thereby deposit fluorine resin with a film thickness of several $\mu$m on the surface thereof.

(4) Image Forming Process

The image forming process of the present embodiment will now be described.

Figure 15:
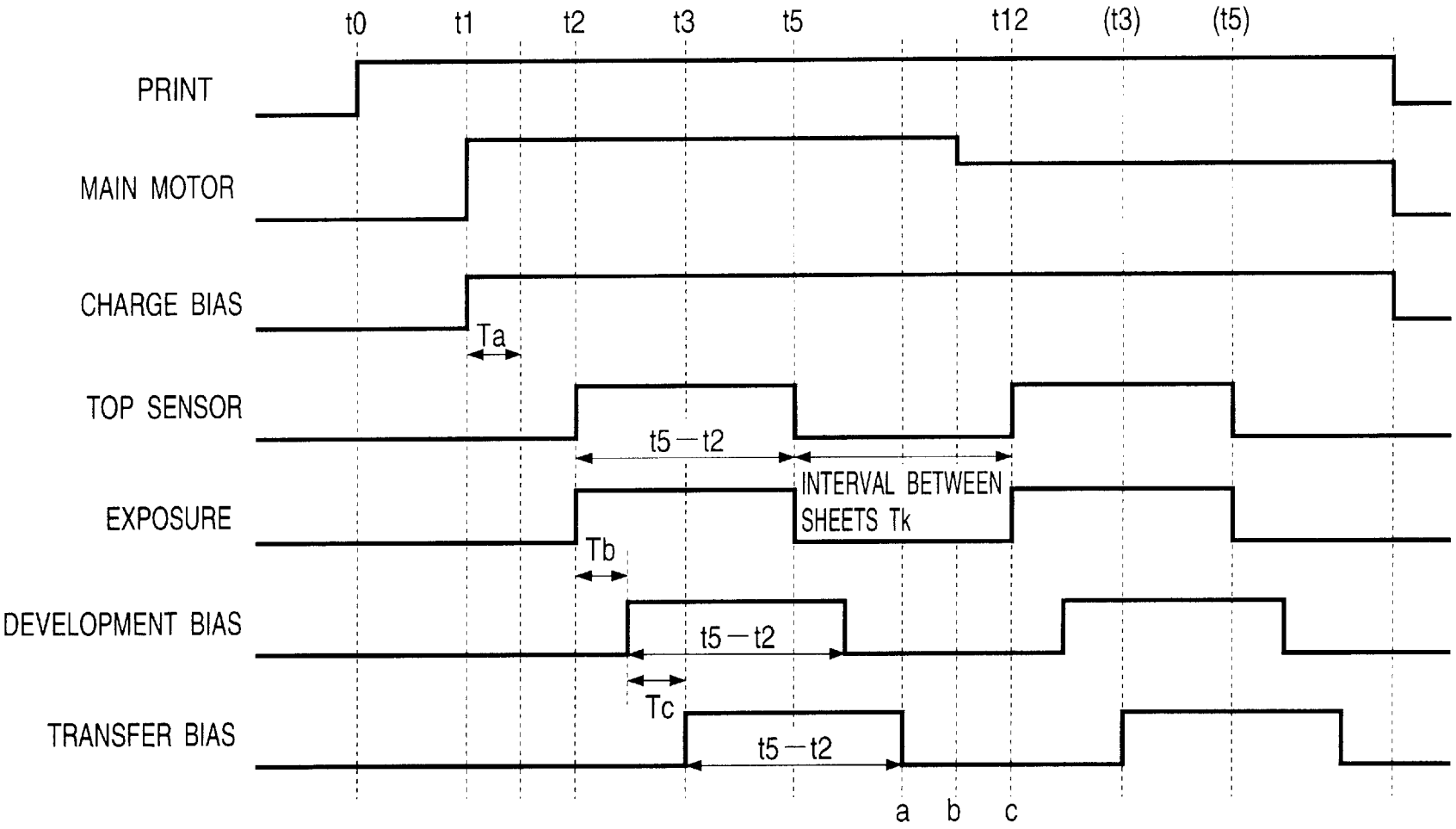
FIG. 15 is a timing chart of the image forming process.
Figure 19:
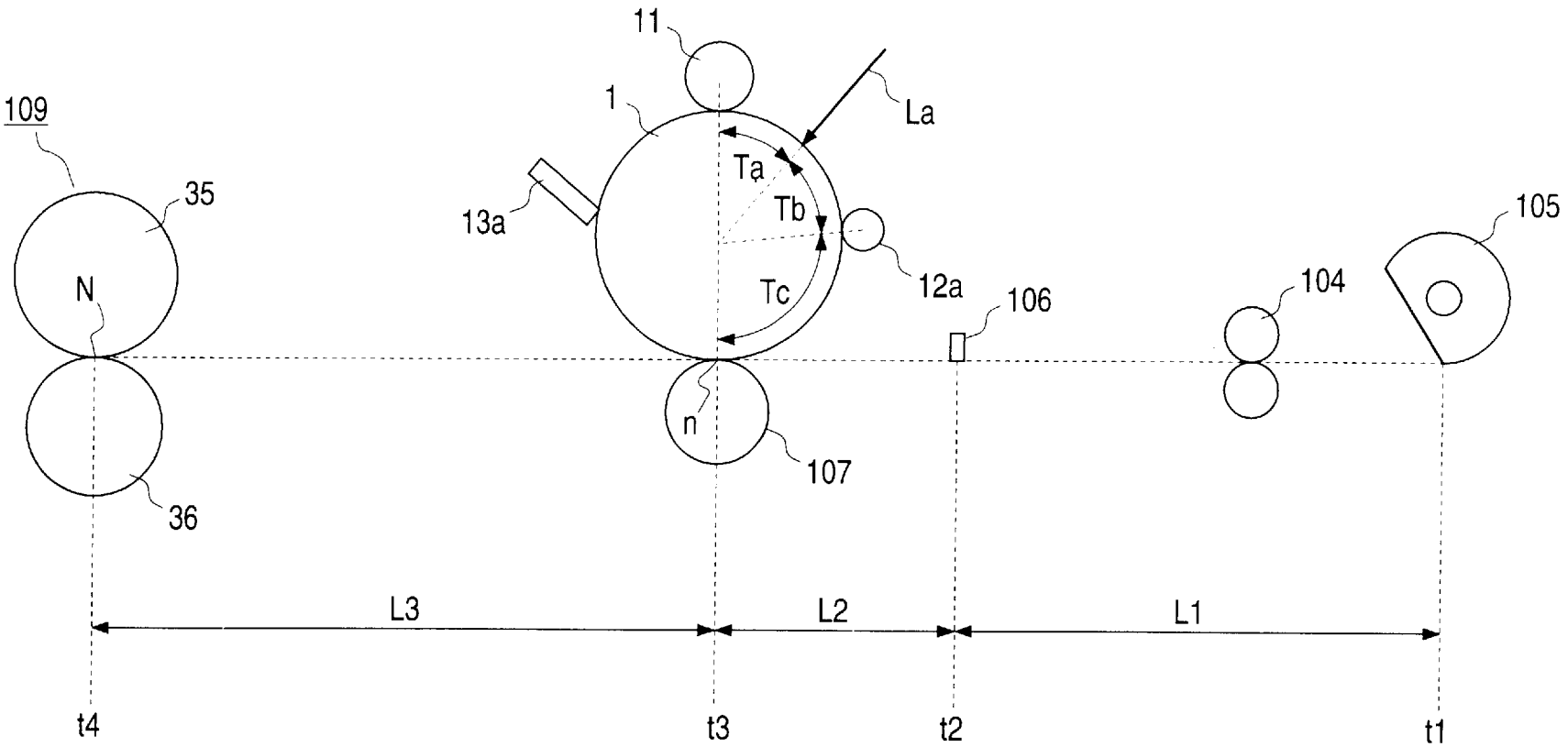
FIG. 19 illustrates the relation between the timing of FIG. 15 and each element of the image forming apparatus.

FIG. 15 is a timing chart from the start of printing till the end of image formation in the apparatus of the present embodiment, and FIG. 19 is an illustration of the relation between the timing of the chart and each element of the image forming apparatus.

In FIGS. 15 and 19, the time of the start of printing is t0=0 (sec.), the time at which paper supply has been started is t1 (sec.), the time until the leading end of the recording medium comes to the top sensor 106 is t2 (sec.), the time until the recording medium P comes to the nip portion (transfer portion) n between the photosensitive member 1 and the transfer roller 107 is t3 (sec.), the time until the recording medium comes to the nip portion (fixing portion) N of the fixing device 109 is t4 (sec.), the time until the trailing end of the recording medium comes to the top sensor 106 is t5 (sec.), the conveyance interval from the paper supply portion to the top sensor 106 is L1 (mm), the conveyance interval from the top sensor 106 to the transfer portion n is L2 (mm), the conveyance interval from the transfer portion to the fixing portion is L3 (mm), the time required for the photosensitive member 1 to be rotated from the charging portion to the exposure portion is Ta (sec.), the time required for the photosensitive member to be rotated from the exposure portion to the developing portion is Tb (sec.), the time required for the photosensitive member to be rotated from the developing portion to the transfer portion is Tc (sec.), and the recording medium conveying speed (process speed) is Vp (mm/sec.).

Thus, when printing is started, the main motor becomes ON and the charging bias becomes ON, and paper supply is started at t1. In an ordinary image forming apparatus, t2−t1≧Ta and during this time, charging has already been effected on the surface of the photosensitive member 1. When the recording medium P comes to the top sensor 106 at t2, the exposure by the laser La is effected in synchronism therewith. After Tb (sec.) at which the exposed surface comes to the developing portion, the developing bias is turned on to thereby effect development. Next, after Tc (sec.) at which the developed surface comes to the transfer portion, the transfer bias is turned on to thereby transfer the toner image onto the recording medium P. This transfer is effected with synchronism taken by the top sensor 106 in order to be effected at a proper position on the recording medium P, and usually t3−t2≧Tb+Tc.

The recording medium P having had the toner image transferred thereto comes to the fixing device 109, where it is subjected to heating and fixation, and is discharged after t4+(t5−t2) (sec.).

Exposure, the development bias and the transfer bias become OFF after the recording medium passage time t5−t2 (sec.), and the apparatus waits for the next printing. The main motor and the charging bias are turned off after the time t4+(t5−t2) (sec.) during which the recording medium is discharged from the fixing device has passed, and waits for the next printing.

Also, when continuous printing has been done, the next recording medium P is supplied with a sheet interval Tk (sec.) conforming to the throughput being kept. If the time when the next recording medium P comes to the top sensor 106 is t12 (sec.), the control after the above-mentioned t2 is repetitively effected after t12.

In the present embodiment, the changeover of the speed (process speed) of the recording medium conveying system (driving system) is effected at the other timing than image exposure and transfer in order to prevent the vibration of the image.

That is, the driving speed of the main motor M is changed at a point of time B between a point of time A shown in FIG. 15 at which the trailing end of the recording medium has passed the transfer portion n (the transfer bias has become OFF) and a point of time C at which the leading end of the next recording medium is detected by the top sensor 106 and image exposure is started in synchronism therewith.

There are shown below some examples of comparative study carried out by the use of the image forming apparatus of the present embodiment in which the process speed has been changed over at such timing and an image forming apparatus according to the prior art.

(Study Example 1)

Apparatus According to the Prior Art

In this study example, there has been carried out the study of the total scale factor (elongation of image) in the conveying direction of the recording medium when continuous printing was effected by an image forming apparatus according to the prior art which is similar in construction to the present embodiment with the exception that the control for changing over the speed of the recording medium conveying system (driving system) is not effected.

In the image forming apparatus used in the study, the process speed is 25 mm/sec., the diameter of the pressure roller 36 at room temperature is 15.9 mm (the outer peripheral length is 50 mm), and the peripheral velocity of the photosensitive member 1 and the pressure roller 36 immediately after printing has been started (before the pressure roller 36 is warmed up) is 25 mm/sec. equal to the process speed.

The distance between the transfer portion n and the fixing portion N is sufficiently short relative to the length of the recording medium P and thus, one and the same recording medium is present in the transfer portion n and the fixing portion N at a time, and the conveying speed of the recording medium P at this time depends on the conveying force of the pressure roller 36.

Figure 17:
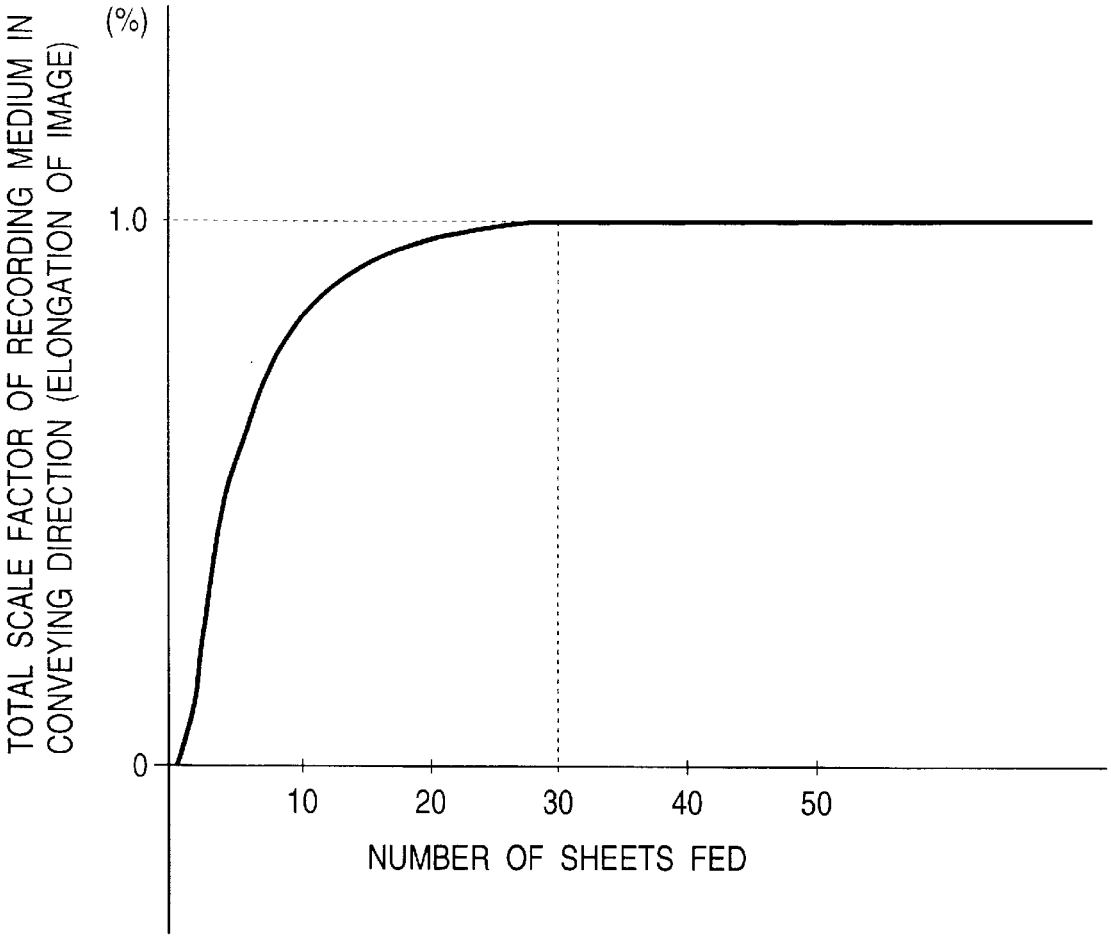
FIG. 17 is a graph showing the relation between the number of recording mediums on which images are formed and the elongation of image.

By the use of the image forming apparatus according to the prior art having such a construction, recording mediums of A4 were continuously printed. FIG. 17 shows a graph representing the relation between the number of recording mediums P fed and the total scale factor (elongation of image) in the direction of conveyance of the recording mediums. The elongation of image reaches nearly +1% for about 30 sheets from the start of printing. This is considered to be because the conveying force of the recording medium is changed by a change in the gripping force of the roller surface due to the thermal expansion or temperature of the pressure roller 36.

When the outer diameter of the pressure roller 36 was measured in its sufficiently warmed state, it was about 16.05 mm. The outer peripheral length of the pressure roller 36 at this time is 50.42 mm, and the peripheral velocity thereof is 25.21 mm/sec. This means an increase of about +0.8% in peripheral velocity relative to the state before the pressure roller 36 becomes sufficiently warm, and the conveying speed of the recording medium P also is substantially similar. In this state, the peripheral velocity of the photosensitive member is 25.21 mm/sec. and therefore, the image on the photosensitive member is elongated in the direction of conveyance when it is transferred to the recording medium P.

(Study Example 2)

Apparatus of the Present Embodiment

In this study example, there has been carried out the study of the total scale factor (elongation of image) in the direction of conveyance of the recording medium when continuous printing was effected by the image forming apparatus of the present embodiment which is similar in construction to the present embodiment with the exception that the control for changing over the speed of the recording medium conveying system (driving system) is effected.

In the image forming apparatus used in the study, the process speed is 25 mm/sec., the diameter of the pressure roller 36 at room temperature is 15.9 mm (the outer peripheral length is 50 mm), and the peripheral velocity of the photosensitive member 1 and the pressure roller 36 immediately after printing has been started (before the pressure roller 36 is warmed up) is 25 mm/sec. equal to the process speed.

From the result of study example 1, it is seen that the temperature of the pressure roller and the elongation of the image increase suddenly immediately after printing has been started. The portion in which the temperature rise of the pressure roller 36 is sharp as shown in FIG. 16 is a stage of temperature control of 190° C. to temperature control of 180° C. of the multiple stages of temperature control effected by the control circuit.

So, in the present example, the correction of the elongation of the image was made at this point of time. That is, at a point of time whereat the temperature control by the control circuit of the fixing device changes over to 170° C. and which is other than image exposure and transfer in order to prevent the vibration of the image, the rotational speed of the main motor M is decelerated by 1% to thereby decelerate the speed of the recording medium conveying system by 1%. That is, the main motor M is decelerated correspondingly to the order of 1% by which the conveying speed by the pressure roller 36 has been increased.

Thus, the exposure device (laser beam scanner) 101 is not operatively associated with the main motor M and therefore, it tries to form a latent image on the photosensitive member at a process speed of 25 mm/sec., but the peripheral velocity of the photosensitive member 1 is decelerated by 1% and thus, the latent image becomes shrinked by 1% in its total scale factor in the direction of rotation, and an image (toner image) shrinked by the developing device 12 is formed. On the other hand, the recording medium P to which this image is transferred is conveyed faster by the order of 1% by the pressure roller 36 relative to the peripheral velocity of the photosensitive member 1.

Consequently, the image formed while being shrinked by 1%, when transferred from the photosensitive member 1 to the recording medium P, is formed while being elongated by 1% in the direction of conveyance and therefore, as the total scale factor, there is obtained an image equal to the image immediately after printing has been started, and the influence of the fluctuation of the conveying force by the temperature rise of the pressure roller 36 can be suppressed.

When recording mediums P of A4 were continuously printed by the use of an image forming apparatus of such a construction, the total scale factor (elongation of the image) in the direction of conveyance of the recording medium could be reduced. Also, the changeover of the process speed was effected at the other point of time than image exposure and transfer and therefore, printing accuracy could be made good without the vibration or the like of the image occurring.

(Fifth Embodiment)

Figure 18:
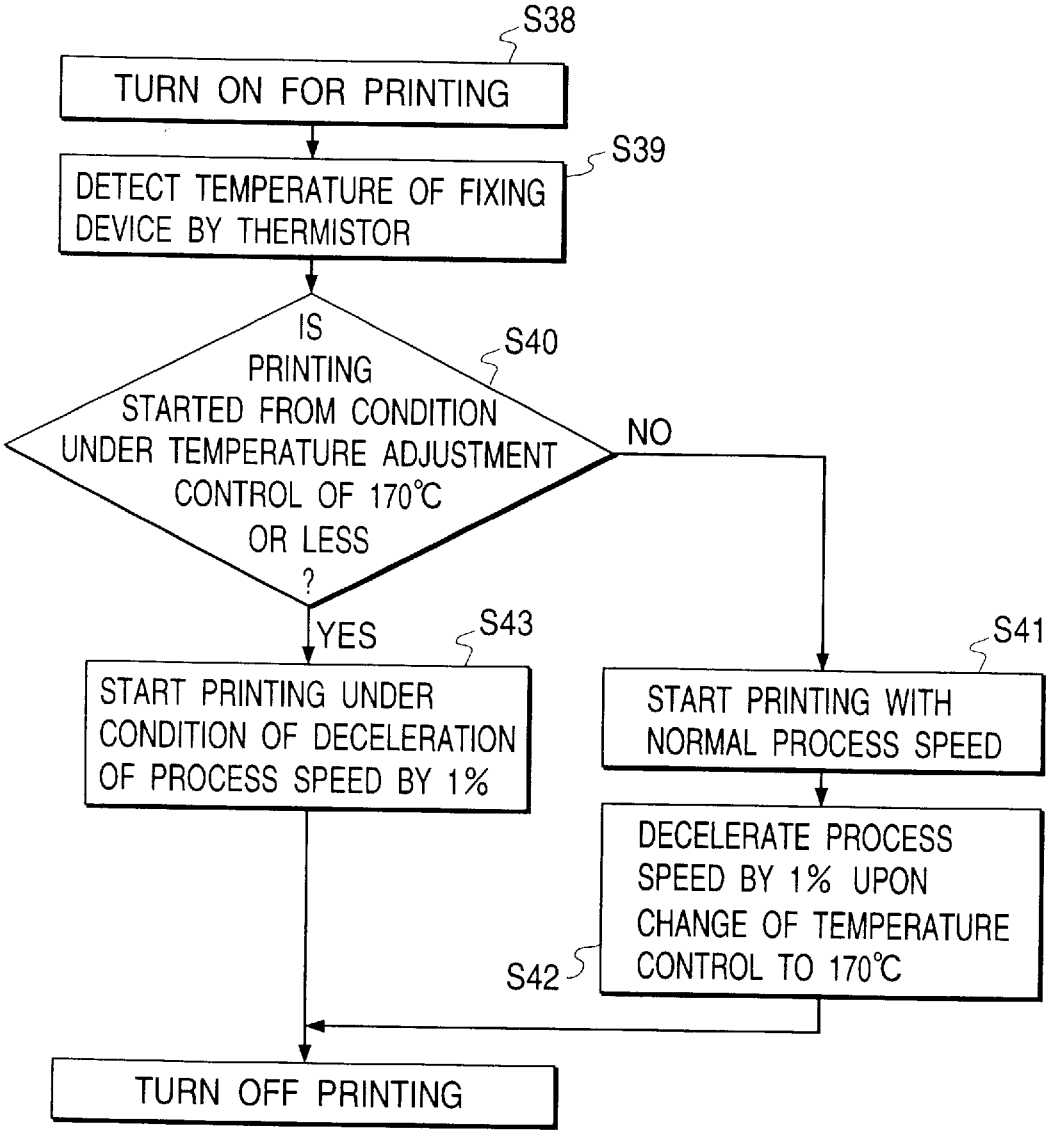
FIG. 18 is a flow chart showing the operation of a fifth embodiment.

This embodiment is one in which contrivance has been made regarding the changeover control of the process speed when intermittent printing is effected, and is similar in the other points to fourth embodiment. FIG. 18 is a flow chart of said control.

The film heating and fixing device 109 of the present embodiment, like the aforedescribed fourth embodiment, effects multiple stages of temperature adjustment control conforming to the temperature of the pressure roller 36. When intermittent printing is effected by the use of this fixing device 109, the control temperature at the start of printing is determined by the temperature detected by the temperature detecting member (thermistor) 33*e* immediately after printing has been started.

That is, when the temperature of the pressure roller is high and the detected temperature by the thermistor 33*e* immediately after printing has been started is high, temperature adjustment control is started from a low temperature and printing is effected, and when the temperature of the pressure roller is low and the detected temperature by the thermistor 33*e* immediately after printing has been started is low, temperature adjustment control is started from a high temperature and printing is effected. Thereafter, such temperature adjustment control as shown in FIG. 16 is effected. Again in this case, the temperature adjustment control is one conforming to the change in the temperature of the pressure roller 36, and as in fourth embodiment, the change in the conveying force of the pressure roller 36 by temperature can be foreseen.

Consequently, in the present embodiment, control for correcting the change in the conveying force of the pressure roller 36 is effected with the detected temperature by the thermistor 33*e* at the start of printing taken into account. This control will hereinafter be described.

As shown in FIG. 18, when printing is turned on (S38), the temperature of the fixing device (fixing portion) is first detected by the thermistor 33*e* (S39), and the control temperature is determined on the basis of this detected temperature, and when printing is started at 180° C. or higher (when printing is not started at 170° C. or less), it is judged that the pressure roller 36 has not been warmed (S40), and printing is started with a normal process speed (S41). Thereafter, as in fourth embodiment, the process speed is decelerated by 1% when the temperature adjustment control changes over to 170° C. (S42).

On the other hand, when printing is started at 170° C. or less on the basis of the detected temperature by the thermistor 33*e*, it is judged that the pressure roller 36 has been warmed and the conveying force of the pressure roller 36 has been increased (S40), and printing is started with the process speed decelerated by 1% (S43).

According to the present embodiment, control for determining the process speed by the detected temperature by the thermistor 33*e*, i.e., the temperature of the pressure roller 36, during the ON of printing, is effected and therefore, in intermittent printing as well, the elongation of the image in the direction of conveyance can be reduced. Also, the changeover of the process speed is effected at the other timing than image exposure and transfer, whereby a blur or the like of the image is not caused.

As regards the timing conforming to the temperature rise of the pressure member for changing over the process speed, besides the above-described example, a temperature detecting member discrete from the thermistor 33*e* may be provided in contact with the pressure roller 36 and the temperature of this roller may be directly measured to thereby determine said timing, or the number of sheets fed for which the conveying force of the pressure member increases or the time from the start of printing (in the case of intermittent printing, the time from the termination of the last printing) may be formed in advance by an experiment, and the point of time at which this has been reached may be regarded as the timing for changing over the process speed.

In any case, it is desirable to change over the process speed at the other timing than image exposure and transfer in order not to cause the vibration or the like of the image.

Also, the fixing device may be a device of a heat roller type in which the wait time is relatively short, like a heating device of an electromagnetic heating type basically comprised of a heat roller generating heat with an alternating magnetic field caused to act on a ferromagnetic metallic roller, and a pressure roller serving also as a drive roller opposed to and urged against the heat roller.

Further, a change in the conveying speed conforming to the size (B5, A4, B4 or the like) of the recording medium may be measured in advance and when as described above, the process speed is to be changed over at the timing conforming to the temperature rise of the pressure member, the size of the recording medium may be detected and the process speed may be changed over to a process speed conforming to said size.

The above-described embodiment is one in which the process speed is changed in conformity with the values (the diameter of the pressure roller and the temperature of the heater) of the fixing device, and description will now be made of an embodiment in which the process speed is changed in conformity with a value based on continuous printing.

(Sixth Embodiment)

(1) An Example of Image Recording Apparatus

Figure 20:
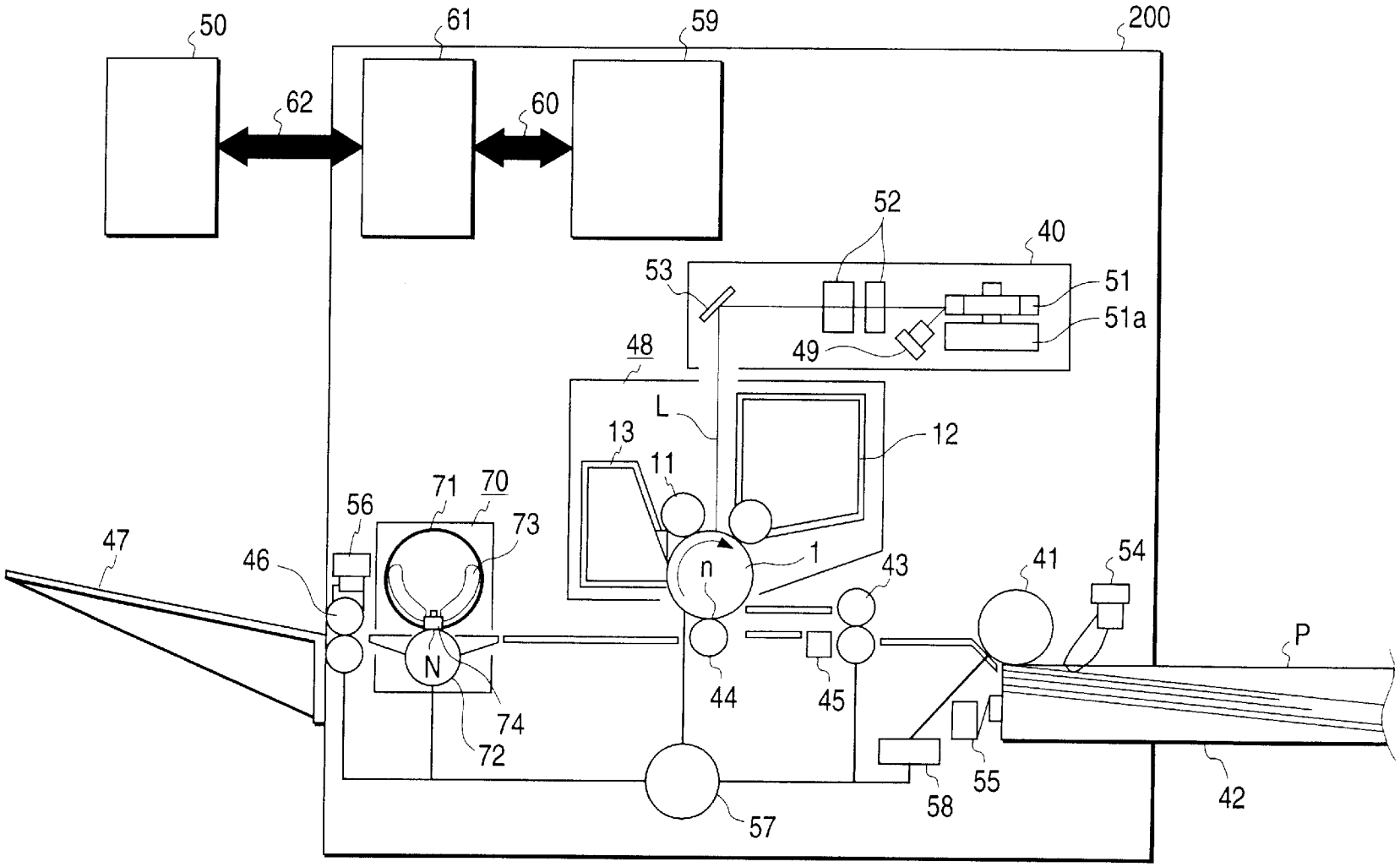
FIG. 20 schematically shows the construction of an image forming apparatus which is a sixth embodiment of the present invention.

FIG. 20 schematically shows the construction of an example of an image recording apparatus. The image recording apparatus 1 of this example is a laser printer utilizing a transfer type electrophotographic process.

Reference numeral 1 designates an electrophotographic photosensitive member of the rotatable drum type (photosensitive drum) as an image bearing member, which is rotatively driven in the direction of arrow at predetermined peripheral velocity (process speed).

The photosensitive drum 1 is uniformly charged to a predetermined polarity and potential in its process of rotation by a primary charging roller 11. Scanning exposure L by a laser beam modulation-controlled (ON/OFF-controlled) correspondingly to the time-serial electrical digital pixel signal of desired image information outputted from a laser scanner portion 40 is done on the uniformly charged surface of the rotatable photosensitive drum 1, whereby the electrostatic latent image of the desired image information is formed on the surface of the rotatable photosensitive drum 1.

The formed latent image is developed and visualized by a toner with the aid of a developing device 12. As the developing method, use may be made of a jumping developing method, a two-component developing method, an FEED developing method or the like, and these are often-used in a combination of image exposure and reverse development.

On the other hand, recording sheets (transfer mediums) P as recording mediums contained in a paper supply cassette 42 are fed out one by one by the driving of a paper feeding roller 41 and is fed to the transfer nip portion n which is the portion of pressure contact between the photosensitive drum 1 and a transfer charging roller 44 at predetermined control timing by a pair of paper conveying rollers (register rollers) 43. Reference numeral 45 denotes a paper sensor provided downstream of the pair of paper conveying rollers 43 with respect to the direction of conveyance of the recording paper for detecting the conveyed state of the fed recording paper.

By the recording paper P being fed to the transfer nip portion n, the toner image on the surface of the photosensitive drum 1 is sequentially transferred onto the surface of the fed recording paper P. The recording paper P which has left the transfer nip portion n is sequentially separated from the surface of the rotatable photosensitive drum 1, is introduced into a fixing device 70 as a heating device for heating and fixing the toner image, and is subjected to the process of heating and fixing the toner image. The fixing device 70 in the present embodiment will be described in detail in the next paragraph (2).

The recording paper which has left the fixing device 70 is printed out onto a piling tray 47 by paper discharge rollers 46.

Also, after the separation of the recording paper, the surface of the rotatable photosensitive drum 1 is subjected to the process of removing any adhering contaminant such as untransferred toner by a cleaner 13 and is cleaned thereby, thus being repetitively used for image formation.

In the printer 200 of this example, four process instruments, i.e., the photosensitive drum 1, the primary charging roller 11, the developing device 12 and the cleaner 13, are collectively made into a process cartridge (image forming portion) removably mountable on the printer body.

In the laser scanner portion 40, reference numeral 49 designates a laser unit which emits a laser beam modulated on the basis of an image signal (image signal VDO) sent out from an external apparatus 50 such as a personal computer. Rreference numeral 51 denotes a polygon mirror for scanning the laser beam from the laser unit 49 onto the photosensitive drum 1, the reference character 51*a* designates a motor for rotating the polygon mirror (polygon motor), reference numeral 52 denotes an imaging lens unit, and reference numeral 53 designates a turn-back mirror.

Reference numeral 54 denotes a cassette paper presence/absence sensor for detecting the presence or absence of recording paper P in the cassette 42, reference numeral 55 designates a cassette size sensor (comprised of a plurality of microswitches) for detecting the size of the recording paper P in the cassette 42, and reference numeral 56 denotes a discharged paper sensor for detecting the conveyed state of the recording paper in a paper discharge portion.

Reference numeral 57 designates a main motor which imparts a drive force to the paper feeding roller 41 through a paper feeding roller clutch 58, and further imparts a drive force to each unit in the image forming portion 48 including the photosensitive drum 1, a fixing device 70, paper discharge rollers 46, etc.

Reference numeral 59 denotes a printer controlling device (engine controller) for controlling the printer body 200, and it is comprised of an MPU (microcomputer) provided with a timer, a ROM, a RAM, etc. and various input and output control circuits or the like.

This printer controlling device 59 is connected to a video controller 61 through a video interface 60 which is internal communication means, and the video controller 61 in turn is connected to the external apparatus 50 such as a personal computer through a generalized interface 62 such as a centronics interface.

The video controller 61 converts image information transmitted from the external apparatus 50 to the printer body 200 through the generalized interface 62 into a video signal, and transmits it to the printer controlling device 59 through the video interface 60.

(2) Fixing Device 70

Figure 21:
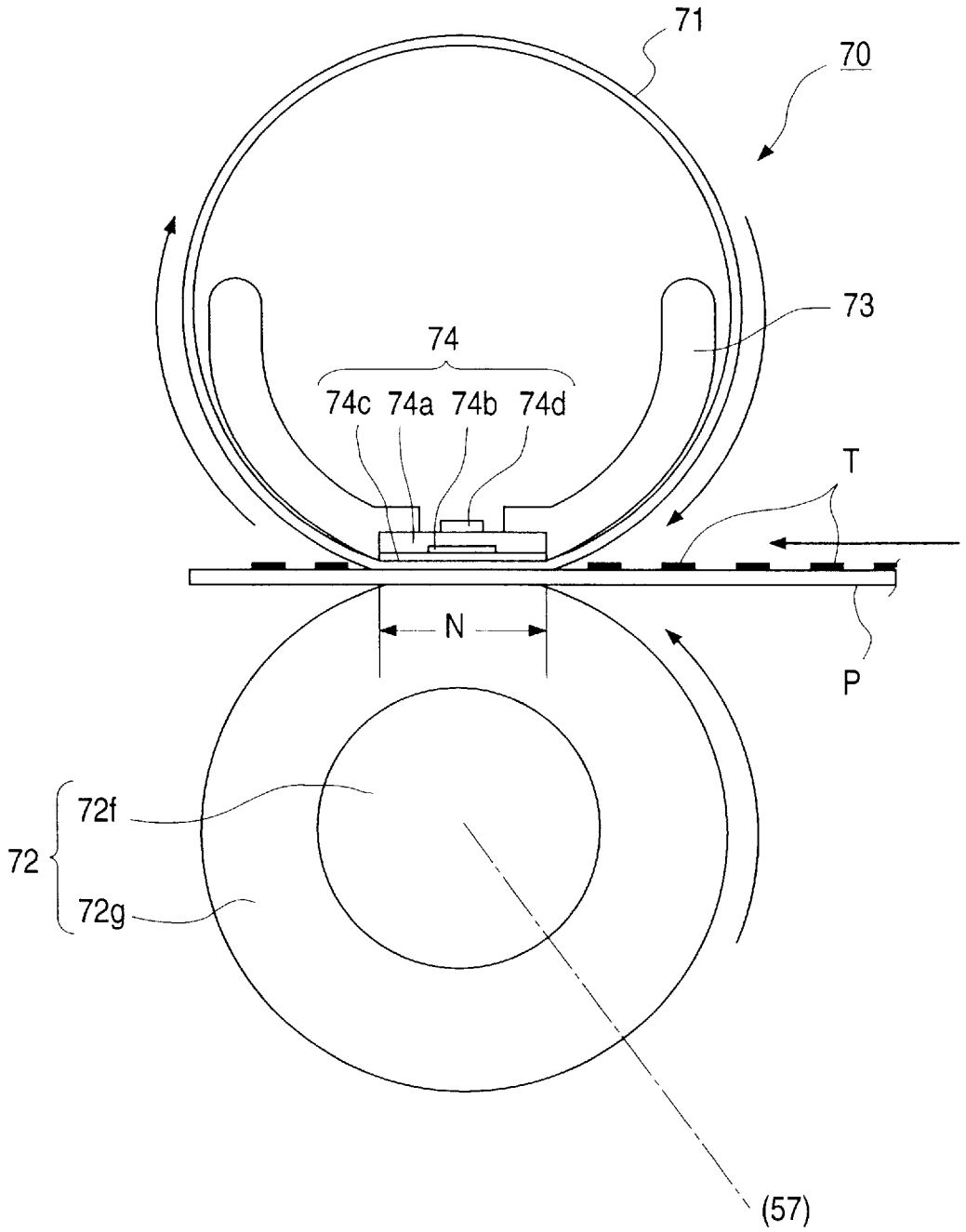
FIG. 21 shows the construction of a fixing device.

FIG. 21 is an enlarged transverse sectional model view of the essential portions of the fixing device 70. The fixing device 70 in the present embodiment is a device of the film heating system of the so-called on demand type, the tensionless type or the pressure roller drive type disclosed in Japanese Laid-Open Patent Application Nos. 4-44075 to 4-44083 and 4-204980 to 4-204984.

That is, cylindrical (endless) heat resisting film (fixing film) 71 is used as a movable member for heating, and at least a portion of the peripheral length of this film is made tension-free (a state in which tension is not applied), and the film 71 is adapted to be rotatively driven by the rotative drive force of a pressure roller 72 as a pressure member (pressure rotatable member).

Reference numeral 73 designates a film inner surface guide stay of a substantially semicircular cross-sectional trough shape having rigidity and adiabatic property, and a ceramic heater 74 as a heating member of low heat capacity is fixedly supported on the underside of the outer surface of this stay along the length thereof. The cylindrical film 71 is loosely fitted on the stay 73 including this heater 74.

The pressure roller 72 comprises a mandrel 72*f* and a heat-resisting elastic layer 72*g* such as a silicone rubber layer formed around this mandrel concentrically and integrally therewith and excellent in parting property, and is urged against the heater 74 with the film 71 interposed therebetween with a predetermined pressure force by bearing means and biasing means, not shown. The letter N denotes the pressure contact nip portion (the heating nip portion and fixing nip portion). A rotative drive force is transmitted from the drive motor 57 to the pressure roller 72 through a power transmitting system, not shown, whereby the pressure roller 72 is rotatively driven at predetermined peripheral velocity in a counterclockwise direction indicated by arrow.

A rotative force directly acts on the film 71 with the frictional force between the pressure roller 72 and the outer face of the film by the rotative driving of the pressure roller 72 (when the recording paper P is introduced into the nip portion N, a rotative force indirectly acts on the film 71 through the recording paper P), and the film 71 rotates in a clockwise direction indicated by arrow while being urged against the underside of the ceramic heater 74.

The film inner surface guide stay 73 facilitates the rotation of the film 71. A small quantity of lubricant such as heat-resisting grease may preferably be interposed between the inner surface of the film 71 and the surface of the ceramic heater 74 in order to reduce the sliding resistance therebetween.

The ceramic heater 74 is heated by the supply of electric power to the electrically energizable heat generating member 74*b* of the ceramic heater 74, and by the heat generation thereof, the rotatable film 71 is heated in the nip portion N. The recording paper P is introduced into the nip portion N between the film 71 and the pressure roller 72 with the unfixed toner image bearing surface facing the film 71 side, whereby the recording paper P is brought into close contact with the film 71 and passes through the nip portion N at a speed corresponding to the rotational peripheral velocity of the pressure roller 72 while being superposed on the film.

In this process wherein the recording paper P passes through the nip portion, heat energy is imparted from the film 71 heated by the ceramic heater 74 to the recording paper P, whereby the unfixed toner image T on the recording paper P is heated, melted and fixed. After having passed through the nip portion N, the recording paper P is separated from the surface of the film 71 and is discharged.

In order to make the heat capacity of the film 71 small and improve the quick starting property thereof, the film thickness of the film 71 may be 100 $\mu$m or less in total, and preferably be greater than 20 $\mu$m and less than 40 $\mu$m. The material of the film 71 is compound layer film comprising the surface of a single layer of PTFE, PFA or FEP having a heat resisting property, a parting property, strength, durability, etc. or film of polyimide, polyamide imide, PEEK, PES, PFA, FEP or the like coated with PTFE, PFA, FEP or the like as a parting layer.

The ceramic heater 74 as a heating member is a linear heating member of generally low heat capacity comprising an elongate heater substrate 74*a* of alumina or the like having, for example, a width of 10 mm and a thickness of 1 mm and having a heat resisting property, an insulative property and good heat conductivity and of which the lengthwise direction is perpendicular to the film 71 in the heating nip portion N or the direction of conveyance of the recording paper P, an electrically energizable heat generating member 74*b* having an electrical resistance material such as Ag/Pd (silver palladium) formed to a thickness of about 10 $\mu$m and a width of 1–3 mm on the central portion of the surface of the substrate with respect to the widthwise direction thereof along the length of the substrate by screen printing or the like, power supply electrodes on the lengthwisely opposite end portions of the electrically energizable heat generating member, a protective layer 74*c* such as glass or fluorine resin covering the surface of the heater on which the electrically energizable heat generating member 74*b* is formed, and a thermistor 74*d* as the temperature detecting means of the heater provided on the back of the heater substrate.

This ceramic heater 74 is fixedly supported on the underside of the outer side of the film inner surface guide stay 73 with its surface provided with the electrically energizable heat generating member 74*b* being downwardly exposed.

The ceramic heater 74 rises in temperature, by the electrically energizable heat generating member 74*b* generating heat over the full length thereof by the supply of electric power to the power supply electrodes on the opposite end portions of the electrically energizable heat generating member 74*b*. The temperature of the heater is detected by the thermistor 74*d* which is temperature detecting means, and the output of this thermistor 74*d* is A/D-converted and introduced into the printer controlling device 59, and on the basis of the information thereof, an AC voltage supplied to the electrically energizable heat generating member 74*b* of the ceramic heater 74 by a triac (not shown) is made into a desired value by phase and wave number control or the like, whereby the temperature of the ceramic heater 74, i.e., the temperature of the fixing device, is controlled so as to be maintained at a predetermined temperature. That is, by controlling the supply of electric power to the electrically energizable heat generating member 74*b* so that the ceramic heater 74 may rise in temperature when the detected temperature of the heater by the thermistor 74*d* is lower than a predetermined set temperature and that the ceramic heater 74 may fall in temperature when said detected temperature is higher than the predetermined set temperature, the temperature of the ceramic heater 74 is adjusted so as to be kept a predetermined temperature during fixation.

The fixing device 70 as a heating device of the film heating system like this example is an on-demand device of the power saving type which can use a heater of low heat capacity as the ceramic heater 74 as a heat generating source and the fixing film 71 and is quick in temperature rise and has a quick starting property, and does not require the supply of electric power for pre-heating.

Also, in the fixing device 70 of the film heating system of the tensionless type like this example, tension acts only on the nip portion N and the film portion in the area of contact between the outer surface portion of the film inner surface guide stay which is upstream of the nip portion N with respect to the direction of rotation of the film and the film during the rotatively driven state of the film, and tension does not act on the most of the remaining portion of the film. Therefore, a force to slide the film 71 along the longitudinal direction of the stay during the rotatively driven state of the film is small and thus, means for regulating locomotion of the film or means for controlling locomotion of the film can be simplified. For example, the regulating means for locomotion of the film can be made into a simple one like a flange member for receiving the end portion of the film, and the locomotion control means can be omitted to thereby achieve a reduction in the cost and downsizing of the apparatus.

(3) Video Interface 60

Figure 22:
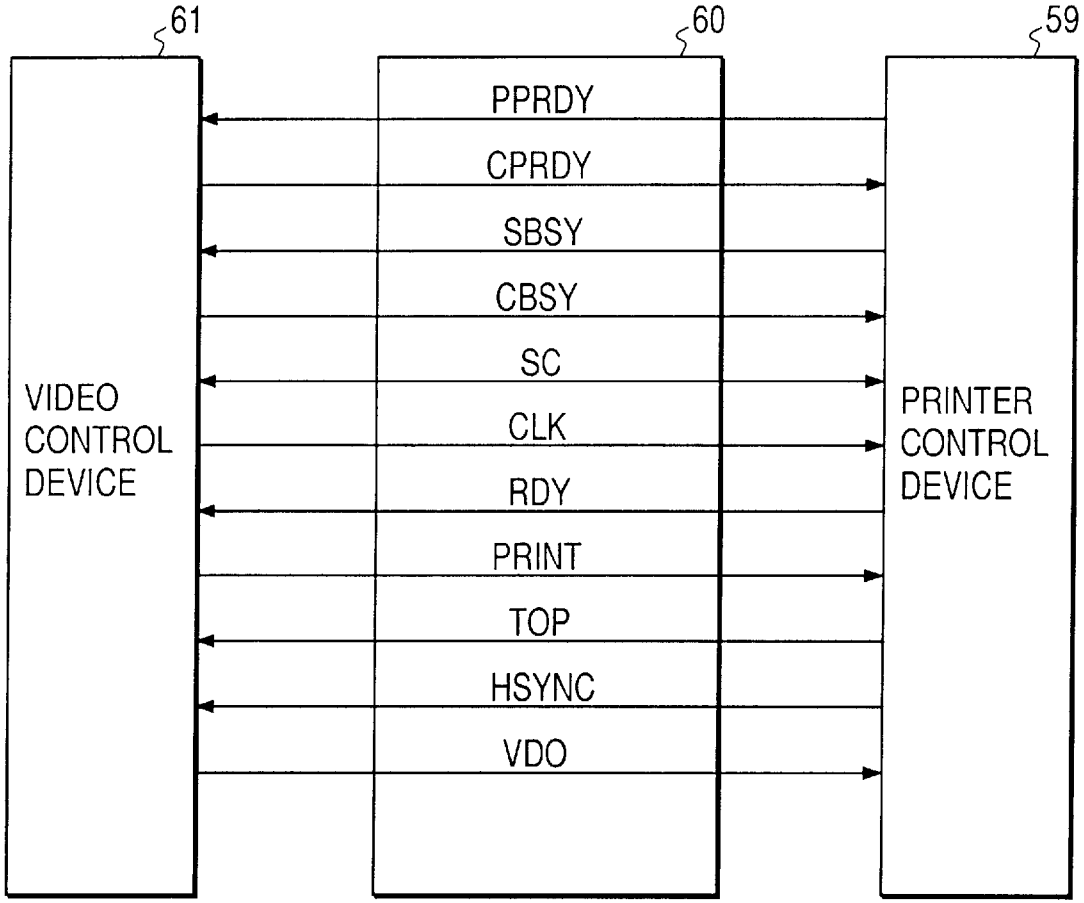
FIG. 22 is a model view of a video interface.

FIG. 22 is a model view illustrating the construction of the video interface 60.

CPRDY: This is a signal indicative of the fact that the external apparatus 50 can effect communication, and is sent from the video control device 61 to the printer controlling device 59.

PPRDY: This is a signal indicative of the fact that the printer controlling device 59 can effect communication, and is sent from the printer controlling device 59 to the video control device 61.

SBSY: This is a status effective signal and is sent from the printer controlling device 59 to the video control device 61.

CBSY: This is a command effective signal and is sent from the video control device 61 to the printer controlling device 59.

SC: This is a status command signal and is sent from the printer controlling device 59 to the video control device 61 as status data indicative of the internal state of the printer when the status effective signal SBSY is TRUE, and is sent from the video control device 61 to the printer controlling device 59 as command data indicative of a command from the video control device 61 to the printer when the command effective signal CBSY is TRUE.

CLK: This is the synchronous clock of the status command signal SC and is sent from the video control device 61 to the printer controlling device 59. In reply to a command from the external apparatus 50, the printer controlling device 59 returns a status corresponding to the command.

That is, serial communication of the handshake type is effected by the above-described signals SBSY, CBSY, SC and CLK.

RDY: This is a ready signal which is made TRUE when the printer controlling device 59 can effect printing, and is sent from the printer controlling device 59 to the video control device 61.

PRINT: This is a print signal which becomes TRUE when the external apparatus 50 instructs the printer to start printing, and is sent from the video control device 61 to the printer controlling device 59.

TOP: This is a vertical synchronous signal taking synchronism in the vertical direction (the sub scanning direction / the paper conveyance direction) of an image output the printer controlling device 59 sends to the video control device 61.

HSYNC: This is a horizontal synchronous signal taking synchronism in the horizontal direction (the main scanning direction / the laser scanning direction) of the image output the printer controlling device 59 sends to the video control device 61.

VDO: This is an image signal by which the video control device 61 serially sends a dot image to the printer controlling device 59 in synchronism with the vertical synchronous signal TOP and the horizontal synchronous signal HSYNC.

(4) Operation of Serial Communication

Figure 23:
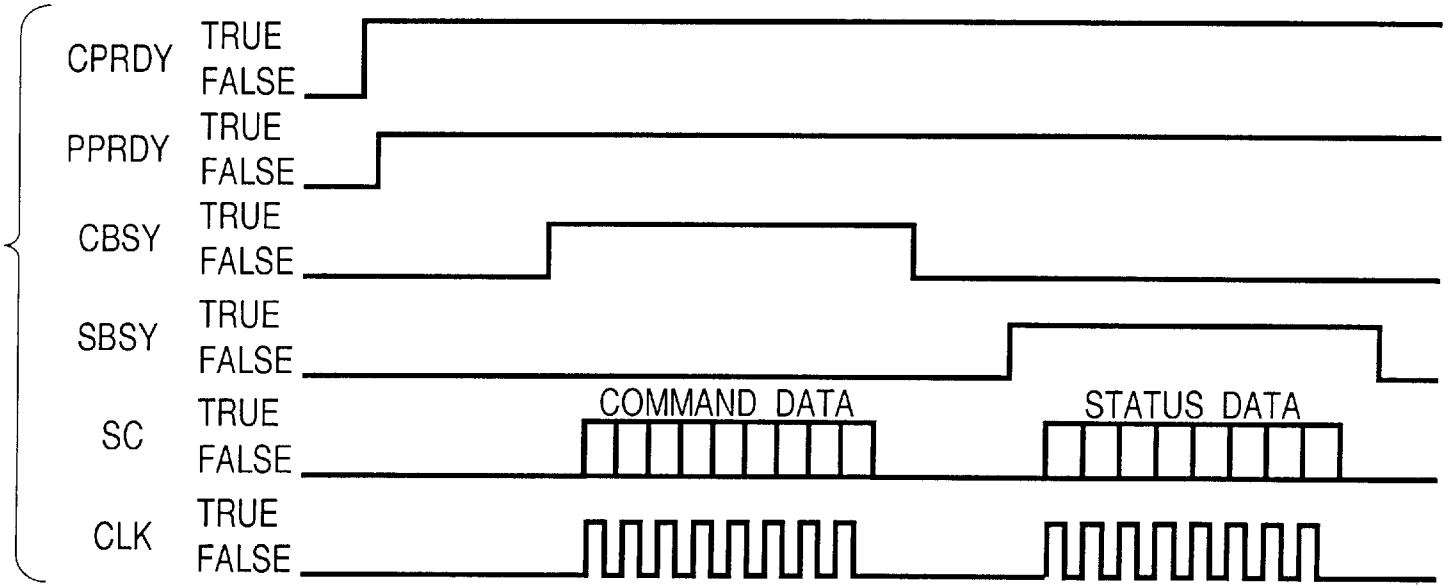
FIG. 23 is a timing chart showing the operation of serial communication.

FIG. 23 is a timing chart showing the operation of the aforedescribed serial communication.

When the power source switch of the printer body 200 is closed and the initialization of the printer controlling device 59 is terminated and a state in which serial communication is possible is brought about, the printer controlling device 59 makes PPRDY TRUE.

On the other hand, when the power source switch of the video control device 61 is closed and the initialization or the like is terminated and a state in which serial communication is possible is brought about, the video control device 61 makes CPRDY TRUE. Also, the video control device 61 confirms that PPRDY is TRUE for a predetermined time and moreover, judges that serial communication is possible, and if necessary, makes CBSY TRUE and sends a command of 8 bits from SC line in synchronism with CLK. Thereafter, it makes CBSY FALSE and waits for the return of the status from the printer controlling device 59.

The printer controlling device 59, when it receives a command, makes SBSY TRUE to return a status conforming to the substance of the command. When it detects that SBSY is TRUE, the video control device 61 starts to send CLK, and the printer controlling device 59 returns the status from SC line in synchronism with CLK, and makes SBSY FALSE.

When it confirms that CPRDY is TRUE for a predetermined time, the printer controlling device 59 judges that serial communication is possible, and judges that the command is effective.

(5) Normal Printing Operation of the Printer 200

Figure 24A:
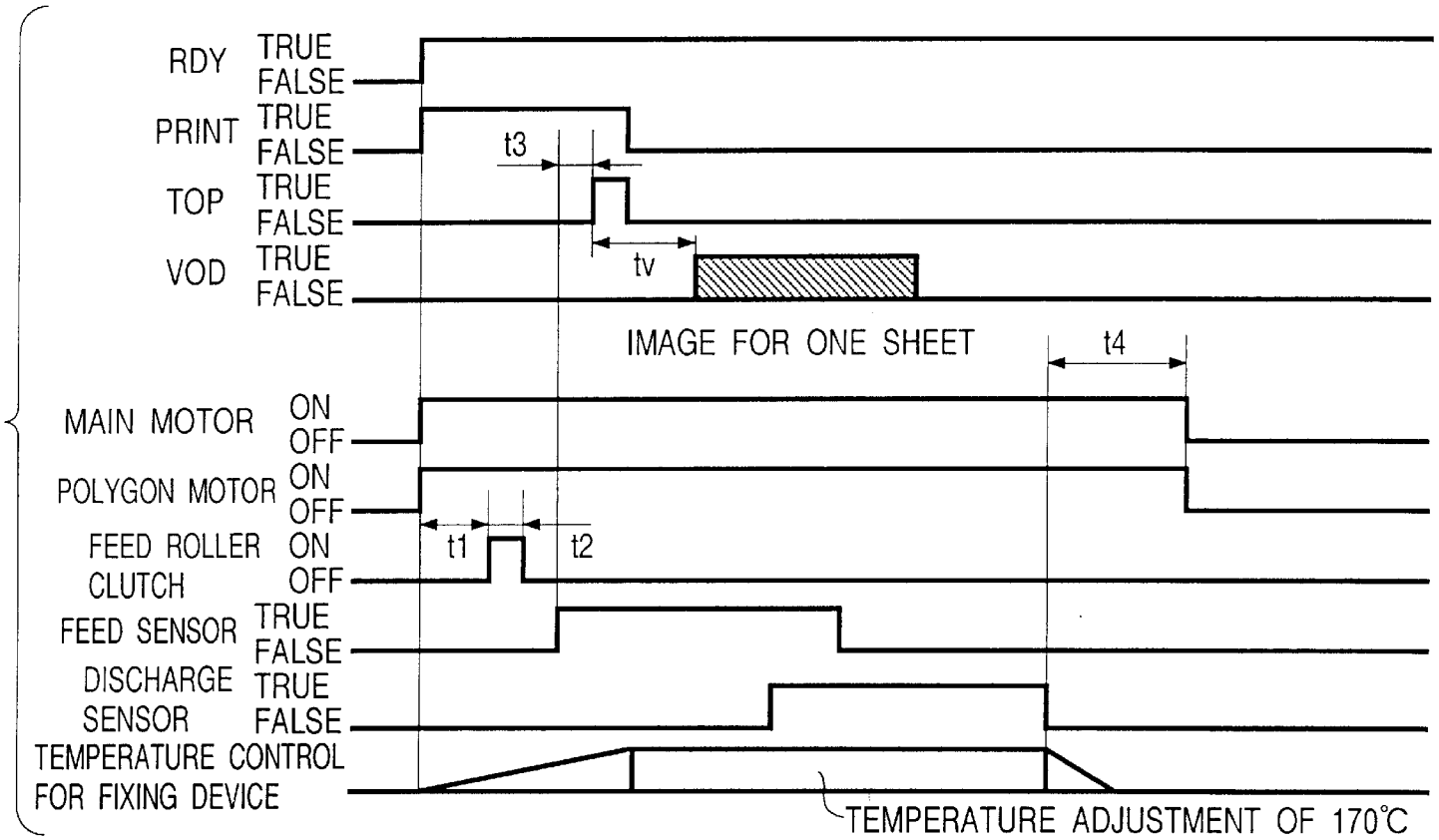
FIGS. 24A and 24B are timing charts showing the image forming operation.
Figure 24B:
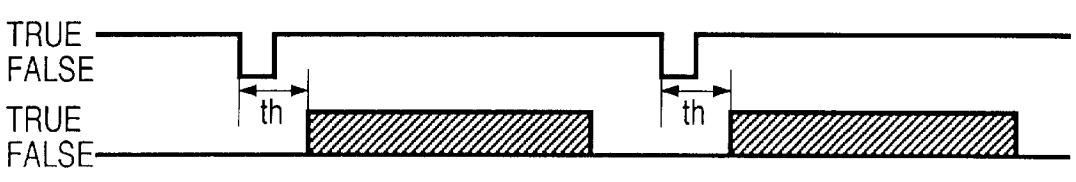

FIGS. 24A and 24B are timing charts showing the normal printing operation of the printer 200.

In FIG. 24A, the printer controlling device 59, when it becomes capable of receiving a print, makes RDY TRUE and informs the video control device 61 that it is capable of receiving a print.

In response to it, the video control device 61, if a requirement for print from the external apparatus 50 arises, makes PRINT TRUE and instructs the printer to start printing.

The printer controlling device 59, when it detects that PRINT is TRUE, starts to drive the main motor 57 and the polygon motor 51a of the laser scanner portion 40.

When the main motor 57 is driven, the drive is transmitted to the paper conveying rollers 43, the photosensitive drum 1, the fixing device 70, the primary charging roller 11, the developing device 12, the transfer roller 44 and the paper discharge rollers 46. At this time, the application of a predetermined high voltage to the primary charging roller 11, the developing device 12, the transfer charging roller 44, etc. is also effected.

Also, the heating of the ceramic heater 74 in the fixing device 70 is started, and the power supply duty to the electrically energizable heat generating member 74*b* of the ceramic heater 74 is controlled so that the temperature of the heater detected by the thermistor 74*d* may become 170° C., whereby the heater (the fixing device) is temperature-adjusted.

The printer controlling device 59 turns on the paper feeding clutch 58 for t2 seconds after t1 seconds at which the rotation of the polygon motor 51*a* assumes a steady state, and drives the paper feeding roller 41 to thereby feed the recording paper P toward the paper conveying rollers 43.

The printer controlling device 59 detects that the leading end of the recording paper P has passed the paper conveying rollers 43 and has arrived at the paper sensor 45, whereupon it sends the vertical synchronous signal TOP to the video control device 61 after a predetermined time t3 seconds.

The video control device 61 starts to output an image signal VDO for one page after tv seconds in synchronism with TOP.

Also, in the meantime, the printer controlling device 59 sends out the horizontal synchronous signal HSYNC to the video control device 61 at predetermined timing synchronized with laser scanning and modulates the laser beam emitted from the laser unit 49 on the basis of the image signal VDO.

The video control device 61 outputs an image signal VDO corresponding to one scan after the seconds in synchronism with the rise of the horizontal synchronous signal HSYNC, as shown in FIG. 24B.

By the operation as described above, the recording paper P is conveyed to the paper feeding roller 41, the paper conveying rollers 43, the transfer nip portion n of the image forming portion 48, the fixing device 70 and the paper discharge rollers 46 in succession, and image recording is done.

When the trailing end of the recording paper P is detected by the discharged paper sensor 56, the temperature adjustment of the ceramic heater 74 of the fixing device 70 is stopped, and the application of a high voltage to the primary charging roller 11, the developing device 12, the transfer charging roller 44, etc. is stopped. In t4 seconds after that, the main motor 57 and the polygon motor 51*a* are stopped, thus terminating the normal printing operation.

In the case of the continuous printing mode, a predetermined interval between sheets (a non-image recording period) is provided after the printing operation of the printer 200, and the continuous printing of a required number of sheets is executed by the repetition of a cycle in which the next printing operation is executed, and when the trailing end of the last sheet of recording paper P is detected by the discharged paper sensor 56, the temperature adjustment of the ceramic heater 74 of the fixing device 70 is stopped, and the application of the high voltage to the primary charging roller 11, the developing device 12, the transfer charging roller 44, etc. is stopped. In t4 seconds after that, the main motor 57 and the polygon motor 51*a* are stopped, thus terminating the continuous printing operation.

(6) Drive Control of the Main Motor 57

Figure 25:
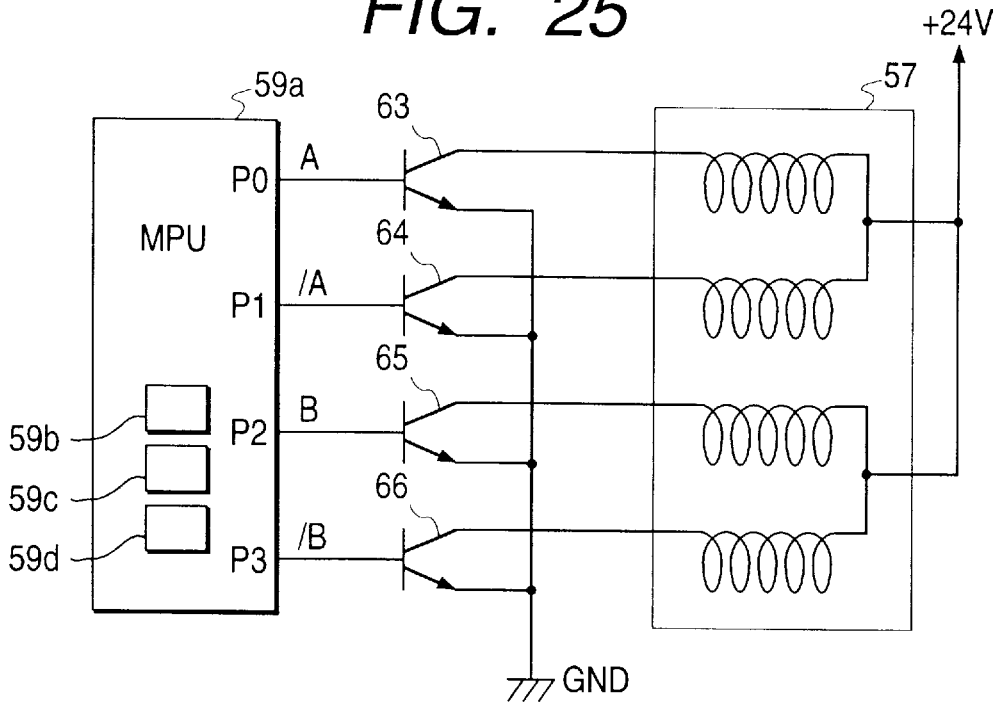
FIG. 25 is a circuit diagram regarding motor control.

FIG. 25 is a circuit diagram of that portion of the printer controlling device 59 which is concerned in the drive control of the main motor 57.

The reference character 59*a* designates a one-chip microcomputer provided with a ROM 59*b*, a RAM 59*c* and a timer 59*d*.

The main motor 57 is a stepping motor of four phases, and one end of the windings of A phase, /A phase, B phase and /B phase is connected to the collectors of NPN transistors 63, 64, 65 and 66, and the other ends of the windings are connected to a +24 V power source. The emitters of the NPN transistors 63, 64, 65 and 66 are connected to GND, and the bases thereof are connected to the output ports P0, P1, P2 and P3, respectively, of the MPU. Surge absorbing diodes for protecting the NPN transistors are not shown in FIG. 25.

Figure 26:
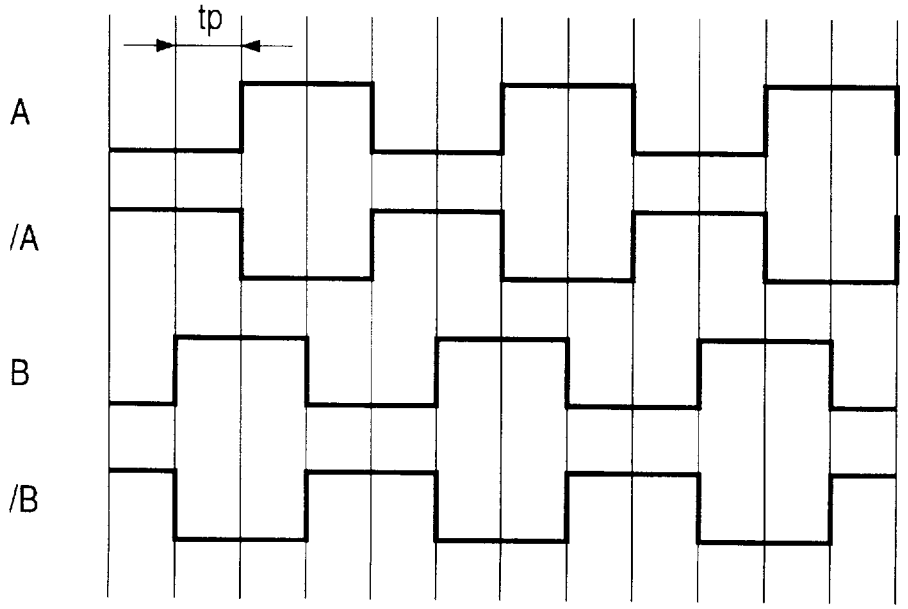
FIG. 26 shows the excitation pattern of a stepping motor.
Figure 27:
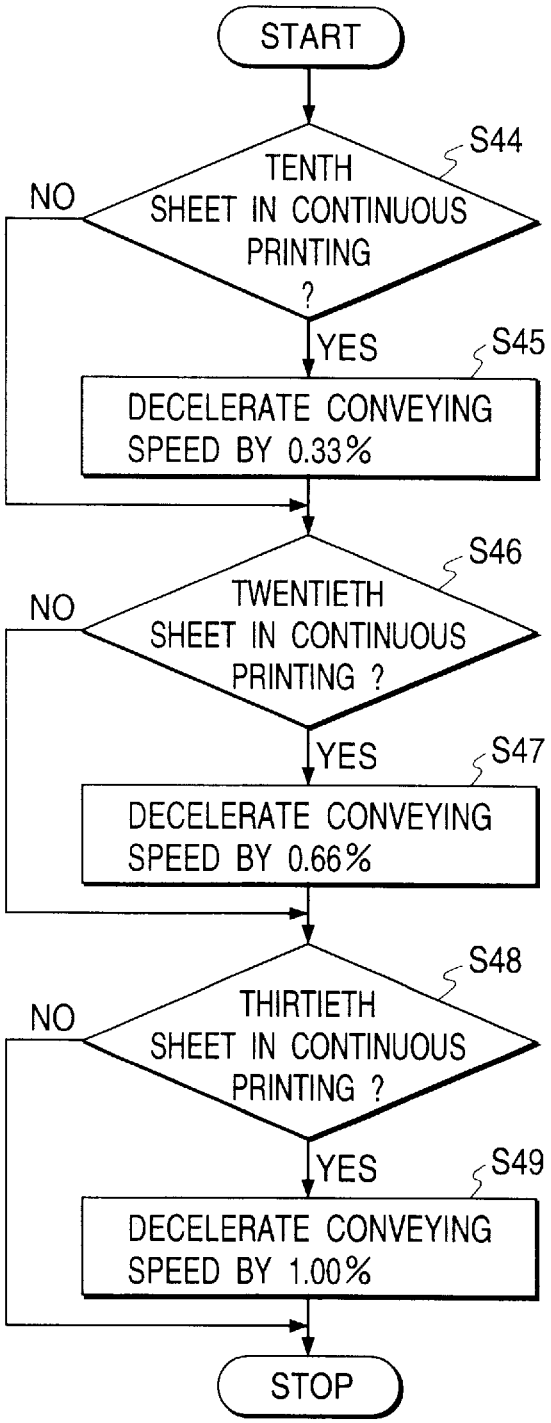
FIG. 27 is a flow chart showing the operation of the sixth embodiment.

FIG. 26 is a timing chart showing an excitation pulse for driving the main motor 57. When the main motor is to be rotated, the MPU 59*a* calculates the frequency of the excitation pulse by the use of the timer 59*d* contained therein, and outputs excitation pulses of A phase, /A phase, B phase and /B phase at a predetermined frequency from the output ports P0, P1, P2 and P3. Accordingly, by changing the frequency of the excitation pulse, the rotational speed of the main motor 57 can be changed.

That is, if the frequency of the excitation pulse is increased by the printer controlling device 59, the rotation of the main motor 57 will become fast and the conveying speed of the recording paper P will become high. If conversely, said frequency is decreased, the rotation of the main motor 57 will become slow and the conveying speed of the recording paper P will become low.

(7) Correction Control of Image Elongation

As previously described, the pressure roller 72 of the fixing device 70 is heated by the heat from the ceramic heater 74 while the printing operation is continuously performed, and rises in temperature and causes the thermal expansion of itself, and the outer diameter thereof is increased from the initial diameter thereof and therefore, as the number of continuously printed sheets (the number of continuously image-recorded sheets) is increased, the image is elongated by the pull conveyance of the recording paper in the transfer portion.

So, in the present embodiment, in order to correct such elongation of the image, the printer controlling device 59 counts the number of continuously printed sheets, controls the rotational speed of the main motor 57 and makes the conveying speed of the recording paper low stepwisely (for each ten sheets), and for 30 sheets or more for which the thermal expansion of the pressure roller 72 is saturated and the elongation of the image is saturated, the speed is maintained.

That is, whether the continuous print is the tenth sheet is judged (step S44), and if it is the tenth sheet, the recording paper conveying speed is reduced by 0.33% relative to the initial value (step S45).

Next, whether the continuous print is the twentieth sheet is judged (step S46), and if it is the twentieth sheet, the recording paper conveying speed is reduced by 0.66% relative to the initial value (step S47).

Next, whether the continuous print is the thirtieth sheet is judged (step S48), and if it is the thirtieth sheet, the recording paper conveying speed is reduced by 1.00% relative to the initial value (step S49).

(1) That is, when the main motor 57 is drive-controlled to reduce its rotational speed, the rotational peripheral velocity of the paper feeding roller 41, the pair of paper conveying rollers 43, the photosensitive drum 1, the transfer charging roller 44, the pressure roller 72 of the fixing device 70 and the paper discharge rollers 46 which constitute the recording paper conveying path leading from the paper feeding roller 41 to the paper discharge rollers 46 becomes lower than the normal rotational peripheral velocity and thus, the recording paper conveying seed becomes lower than the normal conveying speed.

(2) The rotational peripheral velocity of the photosensitive drum 1 becomes lower than the normal rotational peripheral velocity for the predetermined latent image forming speed (invariable even if the main motor changes in its speed) by the exposure means (laser scanner portion) 40 and thus, the latent image and the toner image formed on the photosensitive drum 1 are formed while being shrinked in the direction of rotation of the photosensitive drum by a rate corresponding to the amount of reduction in the rotational peripheral velocity of the photosensitive drum 1.

(3) Even if the main motor 57 is drive-controlled to reduce the recording paper conveying speed, the recording paper conveying speed in the fixing nip portion of the fixing device during continuous printing is greater than the recording paper conveying speed in the transfer portion because the diameter of the pressure roller 72 is increased by thermal expansion, and the recording paper is pull-conveyed in the transfer portion.

(4) Therefore, the toner image formed on the surface of the photosensitive drum 1 while being shrinked in the direction of rotation of the photosensitive drum as described in item (2) above is transferred to the surface of the recording paper pull-conveyed in the transfer portion while elongated in the direction of conveyance of the recording paper.

That is, during continuous printing, as shown in the above-described control flow chart, the main motor 57 is drive-controlled correspondingly to the increase in the recording paper conveying speed in the fixing nip portion by the increase in the outer diameter of the pressure roller of the fixing device based on the thermal expansion thereof to reduce the recording paper conveying speed at a suitable rate, whereby the amount of shrinkage of the toner image formed on the surface of the photosensitive drum 1 while being shrinked and the amount of elongation of the image during transfer are offset and thus, an elongation-corrected toner image is transferred to and formed on the surface of the recording paper.

In the present embodiment, the number of printed sheets is counted up and detected during the reception of the PRINT signal, and the changeover of the recording paper conveying speed is effected during the time from after the PRINT signal has been received until the TOP signal is outputted. That is, the timing at which the recording paper conveying speed is changed is non-image formation time (non-exposure time).

Thus, the change in the elongation rate of the image in one page takes place only once when the leading end of the recording paper has arrived at the pressure roller.

Figure 28:
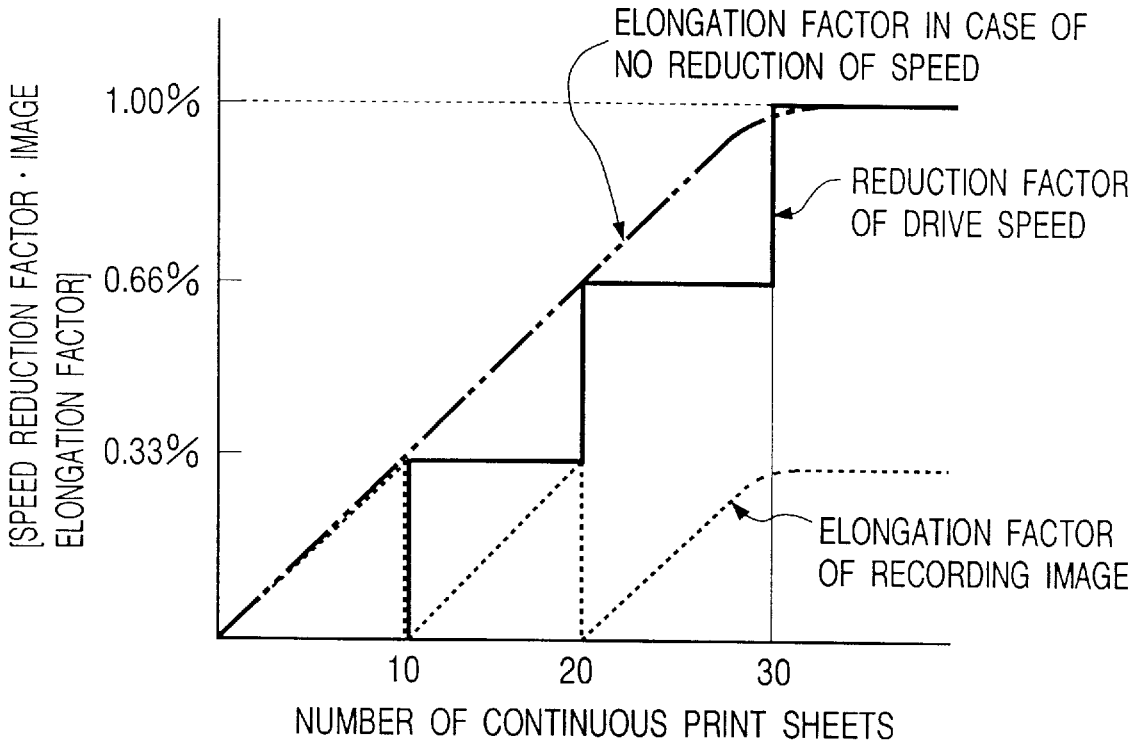
FIG. 28 is a graph showing the relation among the number of recording mediums on which images are formed, the elongation of image and a reduction in a recording medium conveying speed.

FIG. 28 is a graph showing the elongation factor of the recorded image and the reduction factor of the recording paper conveying speed in the process of progress of the number of continuously printed sheets. In this graph, it is assumed that the elongation factor of the recorded image changes substantially linearly for the number of continuously printed sheets. As can be seen in this graph, in the present embodiment, the elongation of the image is suppressed within 33%.

In the present embodiment, the recording paper conveying speed is changed in conformity with the number of continuously printed sheets, but alternatively, the recording paper conveying speed may be changed in conformity with the continuously printing time corresponding to the number of continuously printed sheets.

Figure 29:
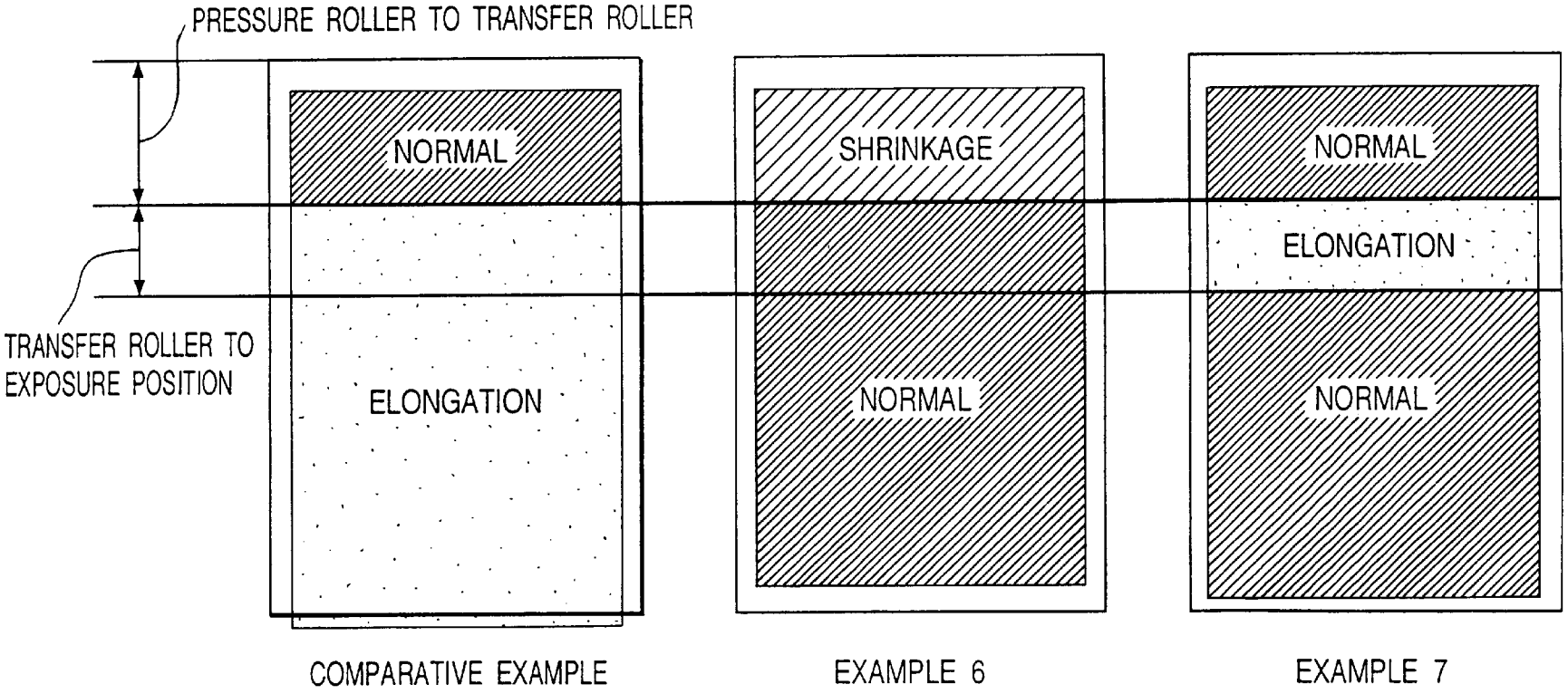
FIG. 29 shows the elongation and shrinkage of a recorded image.
Figure 30:
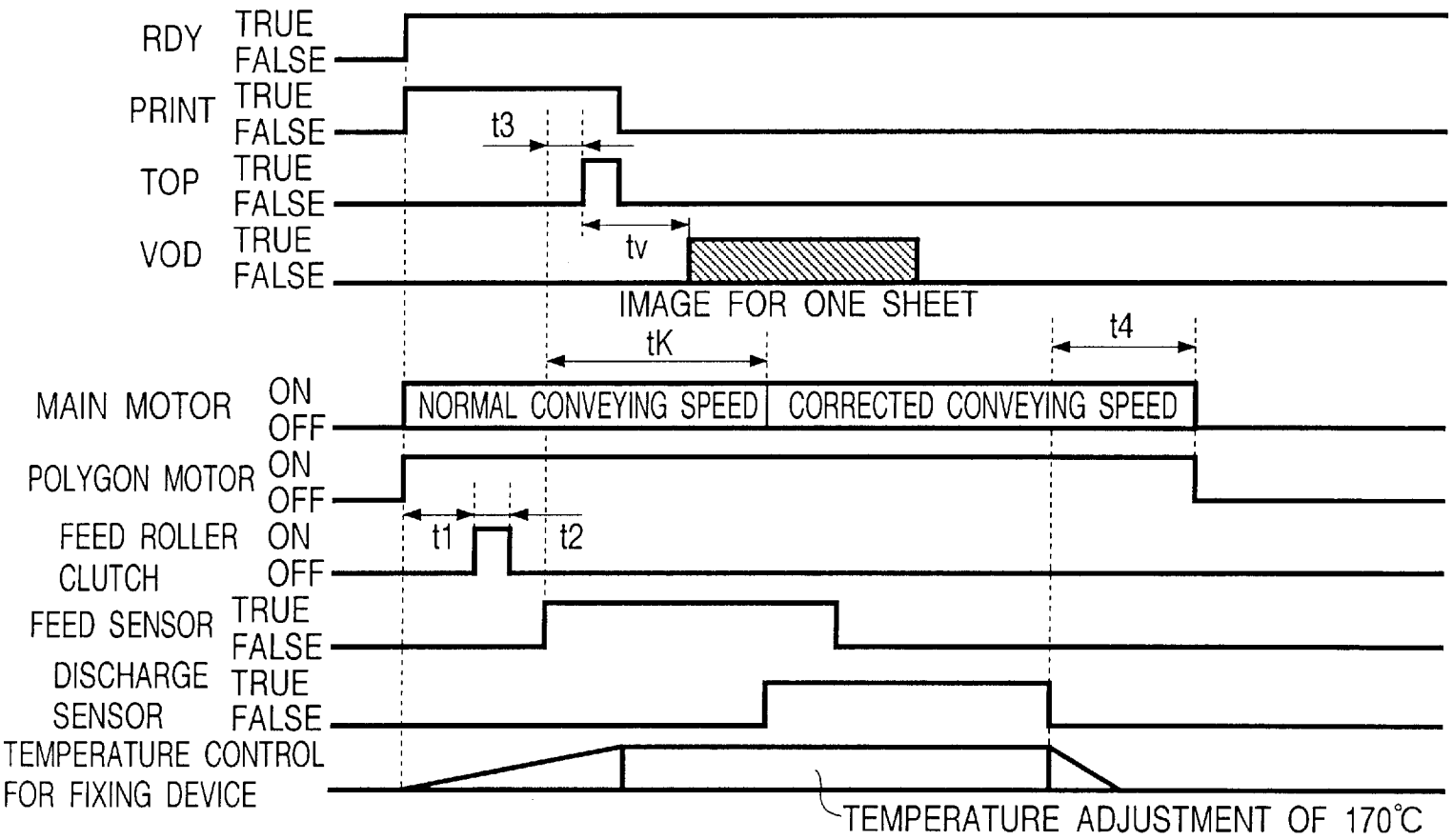
FIG. 30 is a timing chart showing the image forming operation of a seventh embodiment.

(Seventh Embodiment) (FIGS. 29 and 30)

The difference of the printer of this embodiment from the printer of the aforedescribed Example 6 lies in the timing for changing over the recording paper conveying speed. In the other points, the construction of the printer of this embodiment is the same as that of Example 6.

FIG. 29 shows the elongated and shrinked states of the recorded images during continuous printing in a comparative example to which the present invention is not applied, the aforedescribed Example 6 and the present Example 7.

In the comparative example, when the pressure roller 72 is expanded by the progress of continuous printing, the recording paper P is pulled by the pressure roller 72 and therefore, the image transferred after the leading end of the paper has arrived at the nip portion N of the fixing device 70 is elongated.

In the aforedescribed example 6, in order to correct this elongation, the driving speed of the main motor 57 was made low and the recording paper conveying speed was made low so that the elongated portion of the image in the comparative example might be normal. In this case, however, the area in which the image has already been transferred (the area of the pressure roller 72 to the transfer roller 44) when the leading end of the recording paper has arrived at the nip portion N becomes a shrinked image by the toner image formed on the surface of the photosensitive drum 1 while being shrinked being intactly transferred.

In an image forming apparatus wherein the distance between the transfer roller 44 and the pressure roller 72 of the fixing device 70 is somewhat long, there is the possibility that this image-shrinked area may become large and pose a problem.

In this example, such a problem is reduced.

That is, FIG. 30 shows a control timing chart of the present example which differs in the control of the main motor 57 from FIGS. 24A and 24B for the aforedescribed Example 6.

In the present example, recording paper conveyance is effected always at the same speed (initial value), irrespective of the number of continuously printed sheets, until the timing at which the leading end of the recording paper arrives at the pressure roller 72, i.e., the timing tk from the paper sensor 45, and the recording paper conveying speed after the leading end of the recording paper has arrived at the pressure roller 72 is stepwisely reduced as in Example 6 to thereby correct the elongation of the image.

Thereby, the image on the leading end of the recording paper to that area of the recording paper which corresponds to the distance between the pressure roller 72 to the transfer roller 44 can be made into an image free of expansion and shrinkage.

However, as shown in FIG. 29, that slight area of the recording paper which corresponds to the transfer roller 44 to the laser exposure position becomes an area in which the image is elongated. This is because exposure has already been effected when the leading end of the recording paper arrives at the pressure roller 72.

Thus, according to the present embodiment, even in the case of an apparatus in which there is some distance from the transfer portion to the fixing portion, the elongation or shrinkage of the entire recorded image can be appropriately suppressed. Description will now be made of other fixing devices to which the present invention is applicable.

Figure 31B:
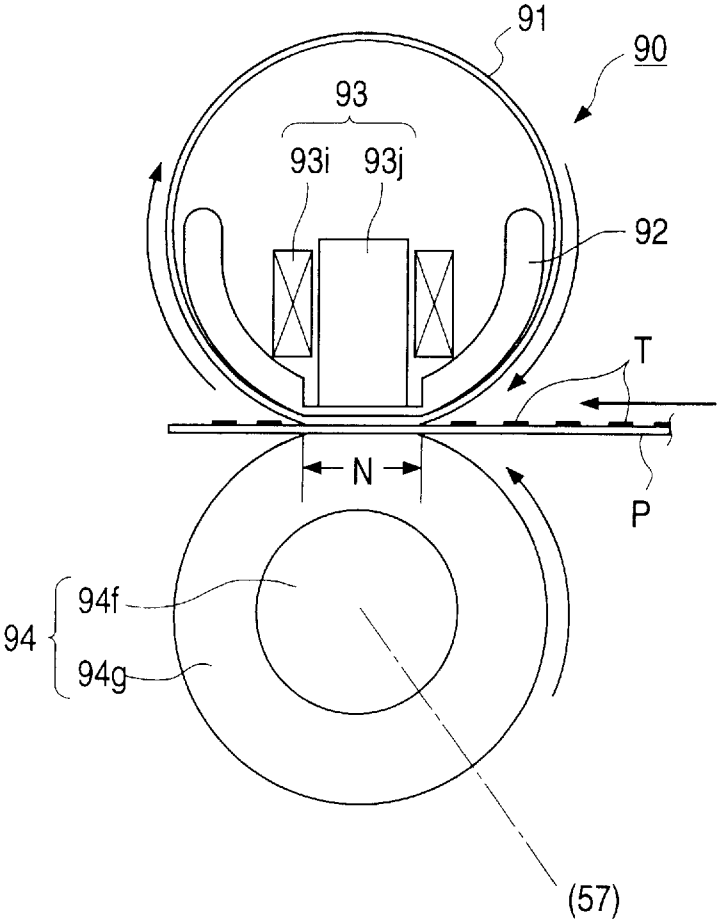
FIGS. 31A and 31B show the constructions of other fixing devices.
Figure 31A:
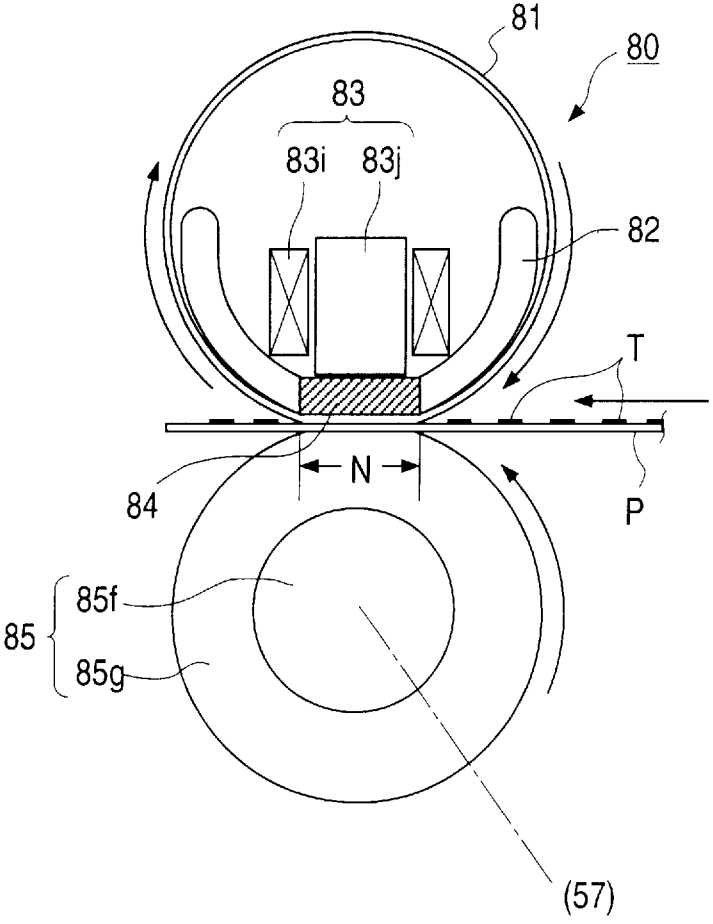

FIGS. 31A and 31B schematically show the constructions of other examples of the on-demand type fixing device. Both of these examples are fixing devices of the electromagnetic inductive heating type.

The fixing device shown in FIG. 31A is provided with a laterally long electromagnetic inductive heat generating plate 84 (a metallic late, an electrically conductive member, a resistance member or a magnetic member) disposed on a film inner surface guide stay 82 instead of the ceramic heater 74 as a heating member in the device of the film heating system of the tensionless type and the pressure roller drive type shown in FIG. 21, and alternating magnetic field producing means 83 comprising an excitation coil 83*i* and an excitation coil 83*j* provided inside the guide stay 82 for causing an alternating magnetic field to act on the electromagnetic inductive heat generating plate 84.

The electromagnetic inductive heat generating plate 84 electromagnetically inductively generates heat (generates heat by the loss of an eddy current) by the action of the alternating magnetic field produced by the alternating magnetic field producing means 83 and functions as a heating member, and by the heat generated thereby, film 81 rotated with the rotative driving of a pressure roller 85 is heated in the nip portion N. Recording paper P is introduced into the nip portion N between the film 81 and the pressure roller 85 with the unfixed toner image bearing surface thereof facing the film 81 side, whereby the recording paper P passes through the nip portion N at a speed corresponding to the rotational peripheral velocity of the pressure roller 85 while being in close contact with and overlapping the film 81. In the process of passage of the recording paper P through this nip portion N, heat energy is imparted from the film 81 heated by the electromagnetic inductive heat generating plate 84 to the recording paper P, whereby the unfixed toner image T on the recording paper P is heated, melted and fixed. After having passed through the nip portion N, the recording paper P is separated from the surface of the film 81 and is discharged. The reference character 85*f* designates a mandrel, and the reference character 85*g* denotes a rubber layer.

The fixing device shown in FIG. 31B is provided with film 91 which is electromagnetic inductive heat generating film, without the ceramic heater 74 as a heating member in the device of the film heating system of the tensionless type and the pressure roller drive type shown in FIG. 21, and alternating magnetic field producing means 93 comprising an excitation coil 93*i* and an excitation coil 93*j* provided inside a film guide 92 for causing an alternating magnetic field to act chiefly on the electromagnetic inductive heat generating film portion in the nip portion N.

By the alternating magnetic field produced by the alternating magnetic field producing means 93, the electromagnetic inductive heat generating film 91 electromagnetically inductively generates heat chiefly in the area of the nip portion N. Recording paper P is introduced into the nip portion N between the film 91 and a pressure roller 94 (94*f* designates a mandrel, and 94*g* denotes a rubber layer) with the unfixed toner image bearing surface thereof facing the film 91 side, whereby the recording paper P passes through the nip portion N at a speed corresponding to the rotational peripheral velocity of the pressure roller 94 while being in close contact with and overlapping the film 91. In the process of passage of the recording paper P through this nip portion, heat energy is imparted from the film 91 electromagnetically inductively generating heat to the recording paper P, whereby the unfixed toner image T on the recording paper P is heated, melted and fixed. After having passed through the nip portion N, the recording paper P is separated from the surface of the film 91 and is discharged.

The pressure roller of the fixing device can be a driven rotational member of other form such as a rotatable belt member.

The transfer means of the image forming portion can be other means such as a transfer corona charger.

The image forming portion is not limited to the electrophotographic process means of the embodiments, but can be suitable image forming process means such as electrostatic recording process means or magnetic recording process means which can form an unfixed image corresponding to desired image information on recording paper by the transfer system or the direct system.

When the next printing operation is to be performed not at a very long time interval after the termination of the printing operation, the pressure roller of the fixing device may have been warmed to a certain degree and therefore, design can also be made such that the printer controlling device 59 detects and refers to the lapser time from after the termination of the last operation at the start of printing, and if this lapse time is short, it is judged that the pressure roller is warm, and if conversely the lapse time is long, it is judged that the pressure roller is cold, and the recording medium conveying speed during the next printing operation is controlled.

Also, the present invention is effectively applicable to any apparatus in which at least the length of a recording medium of the maximum size in the direction of conveyance thereof is greater than the distance from the nip portion of the transfer device to the nip portion of the fixing device.

While the embodiments of the present invention have been described above, the present invention is not restricted to the above-described embodiments, but all modifications are possible within the technical idea of the present invention.

What is claimed is:

1. An image forming apparatus comprising:

a movable image bearing member on which an unfixed image is formed;

transfer means for transferring the unfixed image from said image bearing member to a recording medium;

fixing means for heating and fixing the unfixed image transferred by said transfer means onto the recording medium, said fixing means having a driving rotatable member for conveying the recording medium, and the recording medium being conveyed by said driving rotatable member during the transfer by said transfer means;

detecting means for detecting information regarding a peripheral velocity of said driving rotatable member; and control means for controlling a movement speed of said image bearing member on the basis of the result of the detection by said detecting means.

2. An image forming apparatus according to claim 1, wherein the movement speed of said image bearing member is decreased when it is detected by said detecting means that the peripheral velocity of said driving rotatable member has increased.

3. An image forming apparatus according to claim 1, further comprising exposure means for exposing said image bearing member to form the unfixed image, and wherein the image forming speed of said exposure means is a predetermined speed irrespective of any change in the movement speed of said image bearing member.

4. An image forming apparatus according to claim 1, wherein said driving rotatable member is a roller, and said detecting means detects the diameter of said roller.

5. An image forming apparatus according to claim 4, wherein the movement speed of said image bearing member is changed on the basis of the peripheral velocity of said roller calculated from the diameter of said roller.

6. An image forming apparatus according to claim 1, wherein said fixing means includes a heater maintained at a predetermined control temperature, and said detecting means detects the temperature of said heater.

7. An image forming apparatus according to claim 6, wherein the movement speed of said image bearing member is changed on the basis of said control temperature set in conformity with the temperature of said heater.

8. An image forming apparatus according to claim 7, wherein the movement speed of said image bearing member decreases when said control temperature is set to a low temperature.

9. An image forming apparatus according to claim 6, wherein said detecting means detects the temperature of said heater immediately after image formation is started.

10. An image forming apparatus according to claim 1, wherein said driving rotatable member has a rubber layer.

11. An image forming apparatus according to claim 1, wherein said image bearing member and said driving rotatable member are driven by a single drive source.

12. An image forming apparatus according to claim 1, further comprising charging means for charging said image bearing member, and wherein the charged potential of said image bearing member by said charging means is stabilized before the movement speed of said image bearing member is changed.

13. An image forming apparatus according to claim 12, wherein the control of said charged potential is effected when the movement speed of said image bearing member is a maximum speed.

14. An image forming apparatus according to claim 1, further comprising charging means for charging said image bearing member, and wherein a charged potential of said image bearing member by said charging means is stabilized after the movement speed of said image bearing member is changed.

15. An image forming apparatus according to claim 1, further comprising exposure means for exposing said image bearing member, and wherein a movement speed of said image bearing member is changed during the other time than the exposure by said exposure means.

16. An image forming apparatus according to claim 1, wherein the movement speed of said image bearing member is changed during a time other than during the transfer by said transfer means.

17. An image forming apparatus according to claim 1, wherein said fixing means has a heater provided with a heat generating member adapted to generate heat by being electrically energized, and film sliding on said heater, said driving rotatable member forms a nip with said heater through said film, the recording medium bearing the unfixed image thereon is conveyed by said nip, and the unfixed image is heated and fixed on the recording medium by the heat from said heater through said film.

18. An image forming apparatus according to claim 17, wherein said heater begins to be electrically energized after a signal based on the start of image formation is inputted.

19. An image forming apparatus according to claim 1, wherein said detecting means detects a number of recording mediums on which images are continuously formed.

20. An image forming apparatus according to claim 19, wherein as the number of recording mediums detected by said detecting means increases, the movement speed of said image bearing member decreases.

21. An image forming apparatus according to claim 1, wherein said detecting means detects the image formation time for which an image is continuously formed on the recording medium.

22. An image forming apparatus according to claim 1, wherein the control of the movement speed of said image bearing member is effected after the recording medium arrives at said driving rotatable member.

23. An image forming apparatus according to claim 1, wherein said driving rotatable member is thermally expanded.

24. An image forming apparatus according to claim 1, further comprising charging means for charging said image bearing member, exposure means for exposing said charged image bearing member to form a latent image thereon, and developing means for developing the latent image to thereby form an unfixed toner image.

25. An image forming apparatus according to claim 1, wherein said image bearing member is a rotatively movable drum.

26. An image forming apparatus according to claim 1, wherein said detecting means detects an information regarding the peripheral velocity of said driving rotatable member different from the rotation velocity of said driving rotatable member.

* * * * *

UNITED STATES PATENT AND TRADEMARK OFFICE

CERTIFICATE OF CORRECTION

PATENT NO. : 5,819,149

DATED : October 6, 1998

INVENTORS : YASUNARI WATANABE, ET AL.

It is certified that error appears in the above-identified patent and that said Letters Patent is hereby corrected as shown below:

COVER PAGE [57] ABSTRACT,
Line 10, "with" should read --with a--, and line 12, "and" should read -- and a--.

COLUMN 1,
Line 45, "direct brought into" should read --brought into direct--.

COLUMN 5,
Line 39, "ratio" should read --rate--.

COLUMN 7,
Line 16, "shrinked" should read --shrunk--;
Line 19, "after" should read --after being--;
Line 61, "shrinked" should read --shrunk--;
Line 66, "contin-' should read --continued--; and
Line 67, "uedly performed" should be deleted, and "contin-" should read --continued,--.

UNITED STATES PATENT AND TRADEMARK OFFICE

CERTIFICATE OF CORRECTION

PATENT NO. : 5,819,149

DATED : October 6, 1998

INVENTORS : YASUNARI WATANABE, ET AL.

It is certified that error appears in the above-identified patent and that said Letters Patent is hereby corrected as shown below:

COLUMN 8,
Line 1, "uedly effected," should be deleted; and
Line 9, "shrinked" should read --shrunk--.

COLUMN 9,
Line 41, "seed" should red --speed--;
Line 56, "shrinked" should read --shrunk--;
Line 61, "contin-" should read --continued--;
Line 62, "uedly performed" should be deleted, and
"contin-" should read --continued--; and
Line 63, "uedly effected," should be deleted.

COLUMN 10,
Line 48, "once" should read --first--; and
Line 67, "once" should read --first--.

COLUMN 11,
Line 3, "once" should read --first--;
Line 6, "once" should red --first--; and
Line 64, "shrinked" should read --shrunk--.

UNITED STATES PATENT AND TRADEMARK OFFICE

CERTIFICATE OF CORRECTION

PATENT NO. : 5,819,149

DATED : October 6, 1998

INVENTORS : YASUNARI WATANABE, ET AL.

It is certified that error appears in the above-identified patent and that said Letters Patent is hereby corrected as shown below:

COLUMN 13,
Line 56, "show" should read --slow--.

COLUMN 14,
Line 13, "slidden" should read --slid--.

COLUMN 15,
Line 65, "is" should read --that has been--.

COLUMN 17,
Line 50, "Shrinked" should read --shrunk--; and
Line 57, "shrinked" should read --shrunk--.

COLUMN 18,
Line 67, "the other" should read --a time other than during--.

COLUMN 19,
Line 1, "timing than" should be deleted; and
Line 51, "arrow" should read --the arrow--.

COLUMN 20,
Line 8, "is" should read --are--; and
Line 44, "Rreference" should read --Reference--.

UNITED STATES PATENT AND TRADEMARK OFFICE

CERTIFICATE OF CORRECTION

PATENT NO. : 5,819,149

DATED : October 6, 1998

INVENTORS : YASUNARI WATANABE, ET AL.

It is certified that error appears in the above-identified patent and that said Letters Patent is hereby corrected as shown below:

COLUMN 22,
Line 24, "or film" should read --of film--; and
Line 42, "wisely" should read --wise--.

COLUMN 27,
Line 20, "shrinked" should read --shrunk--;
Line 33, "shrinked" should read --shrunk--;
Line 48, "shrinked" should read --shrunk--; and COLUMN 28,
Line 10, "continuously" should read --continuous--;
Line 18, "shrinked" should read --shrunk--;
Line 37, "shrinked" should read --shrunken--;
Line 39, "shrinked" should read --shrunk--; and
Line 43, "image-shrinked" should read --shrunken-image--.

UNITED STATES PATENT AND TRADEMARK OFFICE

CERTIFICATE OF CORRECTION

PATENT NO. : 5,819,149

DATED : October 6, 1998

INVENTORS : YASUNARI WATANABE, ET AL.

It is certified that error appears in the above-identified patent and that said Letters Patent is hereby corrected as shown below:

COLUMN 29,
Line 16, "late," should read --plate,--.

COLUMN 30,
Line 30, "lapser" should read --lapse of--.

Signed and Sealed this

Twenty-fourth Day of August, 1999

*Attest:*

Q. TODD DICKINSON

*Attesting Officer*

*Acting Commissioner of Patents and Trademarks*